US012071204B1

(12) United States Patent
Ramsdell et al.

(10) Patent No.: US 12,071,204 B1
(45) Date of Patent: Aug. 27, 2024

(54) SPORT BOARD RACK FOR POWER BOAT

(71) Applicant: Malibu Boats, LLC, Loudon, TN (US)

(72) Inventors: Lyle Andrew Ramsdell, Lenoir City, TN (US); Patrick Bryan Dawley, Loudon, TN (US); Matthew Bradford Slayden, Knoxville, TN (US); Jeffrey Lee Predmore, Knoxville, TN (US)

(73) Assignee: Malibu Boats, LLC, Loudon, TN (US)

( * ) Notice: Subject to any disclaimer, the term of this patent is extended or adjusted under 35 U.S.C. 154(b) by 51 days.

(21) Appl. No.: 17/806,179

(22) Filed: Jun. 9, 2022

Related U.S. Application Data

(60) Provisional application No. 63/202,399, filed on Jun. 9, 2021.

(51) Int. Cl.

| | |
|---|---|
| ***B63B 32/83*** | (2020.01) |
| ***A47B 81/00*** | (2006.01) |
| ***B63B 25/00*** | (2006.01) |

(52) U.S. Cl.
CPC ..... *B63B 32/83* (2020.02); *A47B 81/005* (2013.01); *B63B 25/002* (2013.01)

(58) Field of Classification Search
CPC ..... B63B 32/83; B63B 25/002; A47B 81/005
See application file for complete search history.

(56) References Cited

U.S. PATENT DOCUMENTS 3,336,040 A * 8/1967 Hermanns ..... B63B 32/83 280/43.1
3,925,836 A * 12/1975 Simmonds ..... B63B 32/83 114/364
4,232,806 A * 11/1980 Shald ..... B60R 9/12 224/406
4,582,015 A * 4/1986 Hunter ..... B63B 32/83 224/406
4,858,802 A * 8/1989 Hamby ..... B63B 32/83 224/406

(Continued)

FOREIGN PATENT DOCUMENTS

EP 0050566 A1 * 4/1982
FR 2492333 A1 * 4/1982

(Continued)

OTHER PUBLICATIONS

Boating Staff, "Roswell Triton Strapless Board Rack," Boating Magazine, https://www.boatingmag.com/roswell-triton-strapless-board-rack/, dated as updated on Nov. 15, 2018.

(Continued)

*Primary Examiner* — Stanton L Krycinski

(74) *Attorney, Agent, or Firm* — Knobbe, Martens, Olson & Bear, LLP

(57) ABSTRACT

A sport board rack for improving the stowage of one or more boards on a power boat or other watercraft. The sport board rack can include one or more telescoping arms that can pivot independently relative to each other. Each of the telescoping arms can include a claw that can be extended and retracted to secure a board between the claw and two seats of the sport board rack. The claw can be rotated open to ease insertion of a board onto the two seats and rotated closed to secure the board between the claw and two seats when retracted.

23 Claims, 34 Drawing Sheets

(56) References Cited

U.S. PATENT DOCUMENTS

| | | | | | |
|---|---|---|---|---|---|
| 4,863,082 | A * | 9/1989 | Evans | B63B 32/83 | 224/406 |
| 5,316,192 | A * | 5/1994 | Ng | B60R 9/048 | 224/324 |
| 5,582,044 | A * | 12/1996 | Bolich | E05B 73/007 | 224/315 |
| 5,752,638 | A * | 5/1998 | Meeks | B63B 25/002 | 224/558 |
| 5,788,133 | A | 8/1998 | Mareno | | |
| 5,826,908 | A * | 10/1998 | McBride | A63C 11/028 | 280/809 |
| 5,906,304 | A * | 5/1999 | Baldacchino | B63B 32/83 | 224/543 |
| 6,390,309 | B1 * | 5/2002 | Tucker | B63B 32/83 | D6/552 |
| 6,866,001 | B1 * | 3/2005 | Cuccia | B63B 32/83 | 114/364 |
| 6,886,795 | B2 * | 5/2005 | Schultz | B63B 32/83 | 248/316.1 |
| 7,896,175 | B1 * | 3/2011 | Corr | A63C 11/028 | 211/86.01 |
| 8,814,117 | B2 * | 8/2014 | Bohanan | B63B 32/80 | 248/316.1 |
| 8,851,434 | B2 | 10/2014 | Menning et al. | | |
| 8,869,998 | B2 * | 10/2014 | Ferre | A47F 5/01 | 211/106.01 |
| 9,045,090 | B2 * | 6/2015 | Wilhelm | B63B 32/83 | |
| 9,055,826 | B2 * | 6/2015 | Curts | B63B 32/83 | |
| 9,429,269 | B2 * | 8/2016 | Wilhelm | B60R 9/12 | |
| 9,487,153 | B2 * | 11/2016 | Ferré-Rangel | F16M 13/022 | |
| 9,527,562 | B1 * | 12/2016 | Sterling | B63C 15/00 | |
| D801,080 | S * | 10/2017 | Wilson | D6/552 | |
| 10,040,516 | B2 * | 8/2018 | Zimmerman | B63B 25/002 | |
| 10,752,179 | B2 | 8/2020 | Ramsdell et al. | | |
| 10,870,468 | B1 * | 12/2020 | Hellweg | B63B 32/40 | |
| 10,875,610 | B1 | 12/2020 | Hellweg | | |
| 10,982,731 | B2 * | 4/2021 | Hancock | F16M 13/022 | |
| 11,447,211 | B2 * | 9/2022 | Hellweg | B63B 32/40 | |
| 2004/0159759 | A1 * | 8/2004 | Schultz | B63B 32/83 | 211/89.01 |
| 2005/0155999 | A1 * | 7/2005 | Gasper | B60R 9/08 | 224/406 |
| 2007/0057000 | A1 * | 3/2007 | Webster | B60R 9/06 | 224/531 |
| 2007/0062992 | A1 * | 3/2007 | Hepworth | B60R 9/08 | 224/558 |
| 2007/0209567 | A1 * | 9/2007 | Fee | B63B 17/00 | 114/1 |
| 2013/0022440 | A1 | 1/2013 | Sautter et al. | | |
| 2013/0062383 | A1 | 3/2013 | Jeli | | |
| 2014/0263906 | A1 * | 9/2014 | Jesewitz | B63B 32/83 | 248/288.11 |
| 2015/0158431 | A1 * | 6/2015 | Parnell | B60R 9/08 | 211/85.7 |
| 2015/0338020 | A1 * | 11/2015 | Jesewitz | B63B 32/83 | 248/288.11 |
| 2021/0071738 | A1 * | 3/2021 | Hancock | F16G 11/12 | |
| 2022/0371699 | A1 * | 11/2022 | Lake | B63B 32/83 | |

FOREIGN PATENT DOCUMENTS

| | | | |
|---|---|---|---|
| FR | 2499933 | A2 * | 8/1982 |
| FR | 2532611 | A1 * | 3/1984 |
| FR | 2534220 | A1 * | 4/1984 |

OTHER PUBLICATIONS

WakeMAKERS, "Roswell Triton Clamping Wake/Surf Board Rack," YouTube, https://www.youtube.com/watch?v=n3GldJeQaxU, dated as uploaded on Mar. 2, 2017.

Team Talk, "Mastercraft OEM Wakeboard Rack Clamping Fingers," MasterCraft, https://teamtalk.mastercraft. com/forum/classifieds-buy-sell/for-sale-parts-accessories/74612-mastercraft-oem-wakeboard-rack-clamping-fingers, dated as uploaded on Sep. 15, 2016.

Team Talk, "2003 OEM Clamping Board Racks," MasterCraft, https://teamtalk.mastercraft. com/forum/classifieds-buy-sell/for-sale-parts-accessories/77995-2003-oem-clamping-board-racks?t=80059, dated as uploaded on May 25, 2017.

* cited by examiner

SPORT BOARD RACK FOR POWER BOAT

CROSS REFERENCE TO RELATED APPLICATIONS

This application claims priority to U.S. Provisional Patent Application No. 63/202,399, filed Jun. 9, 2021, which is incorporated herein by reference in its entirety. Any and all applications, if any, for which a foreign or domestic priority claim is identified in the Application Data Sheet of the present application are hereby incorporated by reference under 37 CFR 1.57.

FIELD

The present application relates generally to improving stowage for a board rack and, more particularly, to a sport board rack for a power boat.

BACKGROUND

Water sports that utilize a sport board and a power boat have become increasingly popular. Different boards are required for different water sports. For example, surfboards are used for wake surfing and wakeboards are used for wakeboarding. Furthermore, different riders may have preferences for one surfboard over another or one wakeboard over another. Thus, changing boards, which may be desired in the middle of a body of water, for different water sports and riders can frequently occur.

SUMMARY

Securely storing different sport boards on a power boat to facilitate frequent board changes out on the water can be challenging because the boards may be different shapes and sizes (e.g., surfboards are generally thicker and wider than wakeboards). Power boats may change directions quickly, porpoise, and/or travel at fast speeds, and if a board is not secured, the board may come loose and fall into the water, damage the boat, injure a passenger, and/or damage itself. Accordingly, a user's experience can be enhanced by improving the secure stowage of multiple sport boards of varying sizes and shapes on a power boat, such as a water-sports boat. Although various embodiments are disclosed herein in connection with power boats and water-sports boats, other types of boats and other watercraft, can include the improved sport board racks according to the embodiments disclosed herein. Additionally, the sport board racks disclosed herein can be incorporated in other vehicles not used on the water, such as automobiles (cars, truck, etc.), snowmobiles, utility task vehicles, all-terrain vehicles, etc. Although various embodiments of board racks are disclosed herein in connection with holding wake boards and surfboards, other sport boards and gear may be held which can at least include skis, paddle boards, boogie boards, foil boards (e.g., foil surfboards), electric foil boards, snowboards, and/or others.

Various embodiments of a sport board rack are disclosed herein. In some variants, the board rack can be incorporated onto a power boat. The board rack can include a base. The board rack can include a first pair of seats that can to receive a first board. The board rack can include a second pair of seats that can receive a second board. The board rack can include a first telescoping arm that can move between an extended position and a retracted position. The first telescoping arm can include a first claw that can cooperate with the first pair of seats to secure the first board between the first claw and the first pair of seats. The board rack can include a second telescoping arm that can move between an extended position and a retracted position. The second telescoping arm can include a second claw that can cooperate with the second pair of seats to secure the second board between the second claw and the second pair of seats. The first telescoping arm and the first pair of seats can pivot together with respect to the base. The second telescoping arm and the second pair of seats can pivot together with respect to the base.

In some variants, the first claw and the second claw can rotate between an open configuration to facilitate placing the first board and the second board on the first pair of seats and the second pair of seats, respectively, and a closed configuration to facilitate securing the first board between the first claw and the first pair of seats and the second board between the second claw and the second pair of seats.

In some variants, each of the first telescoping arm and the second telescoping arm can include a lever that can be manipulated to rotate the first claw and the second claw between the open configuration and the closed configuration.

In some variants, each of the first telescoping arm and the second telescoping arm can include a release that can be manipulated to enable the first telescoping arm and the second telescoping arm to be pushed to the extended position.

In some variants, each of the first telescoping arm and the second telescoping arm can include an inner arm and an outer arm. The inner arm can be moved within the outer arm to move between the extended position and the retracted position.

In some variants, each of the first telescoping arm and the second telescoping arm can include a pawl and a ratchet insert. The pawl can be biased by way of a spring to engage with teeth of the ratchet insert to prevent moving of the first telescoping arm and the second telescoping arm to the extended position without manipulating a release.

In some variants, the board rack can include a first shaft and a second shaft. The first telescoping arm and the first pair of seats can be coupled to the first shaft. The second telescoping arm and the second pair of seats can be coupled to the second shaft.

In some variants, longitudinal lengths of the first telescoping arm and the first shaft can be perpendicularly orientated relative to each other and longitudinal lengths of the second telescoping arm and the second shaft can be perpendicularly orientated relative to each other.

In some variants, the board rack can include a first lever and a second lever. The first lever can engage the first shaft to lock the first shaft in a position of rotation. The second lever can engage the second shaft to lock the second shaft in a position of rotation.

In some variants, the first lever and the second lever can be manipulated to release the first shaft and the second shaft for rotation.

In some variants, a board rack is disclosed that can be incorporated onto a power boat. The board rack can include a base that can be incorporated with a tower of the power boat. The board rack can include a first seat and a second seat. The first seat and the second seat can receive a board. The board rack can include a telescoping arm that can move between an extended position and a retracted position. The telescoping arm can include a claw that can rotate between an open position and a closed position. The board rack can secure the board between the claw, the first seat, and the second seat with the claw rotated to the closed position and the telescoping arm retracted.

In some variants, the telescoping arm can be rotatably mounted to the base.

In some variants, the telescoping arm can rotate with the first seat and the second seat.

In some variants, the telescoping arm is a first telescoping arm and the board rack can further include a second telescoping arm.

In some variants, the telescoping arm can further include a housing that can be pulled toward the first seat and the second seat to retract the telescoping arm.

In some variants, the housing can include a release and a lever. The release can be manipulated to rotate the claw open and permit extension of the telescoping arm. The lever can be manipulated to rotate the claw closed.

In some variants, the telescoping arm can further include a pawl and a ratchet insert. The pawl can be biased by way of a spring to engage with teeth of the ratchet insert to prevent moving of the telescoping arm to the extended position without manipulating the release.

In some variants, the telescoping arm can further include a housing coupled to the pawl. The housing can be pushed and the release manipulated to rotate the pawl to disengage from the teeth of the ratchet insert.

In some variants, the telescoping arm can further include a cable that can be coupled to the claw and a lever. The lever can be manipulated to pull the cable to rotate the claw to the closed position.

In some variants, a board rack is disclosed that can be incorporated onto a power boat. The board rack can include a base. The board rack can include a first seat and a second seat. The first seat and the second seat can receive a board. The board rack can include a telescoping arm that can be moved between an extended position and a retracted position. The telescoping arm can include a claw that can rotate between an open position and a closed position. The board rack can include a housing that can include a trigger. The housing can be pushed to rotate the claw open and move the telescoping arm to the extended position and pulled to move the telescoping arm to the retracted position. The trigger can be squeezed to rotate the claw closed. The board rack can secure the board between the claw, the first seat, and the second seat with the claw rotated to the closed position and the telescoping arm retracted.

BRIEF DESCRIPTION OF THE DRAWINGS

Various embodiments are depicted in the accompanying drawings for illustrative purposes and may not be drawn to scale, and should in no way be interpreted as limiting the scope of the embodiments. In addition, various features of different disclosed embodiments can be combined to form additional embodiments, which are part of this disclosure.

DETAILED DESCRIPTION

Although certain embodiments and examples are described below, this disclosure extends beyond the specifically disclosed embodiments and/or uses and obvious modifications and equivalents thereof. Thus, it is intended that the scope of this disclosure should not be limited by any particular embodiments described below.

Figure 1A:
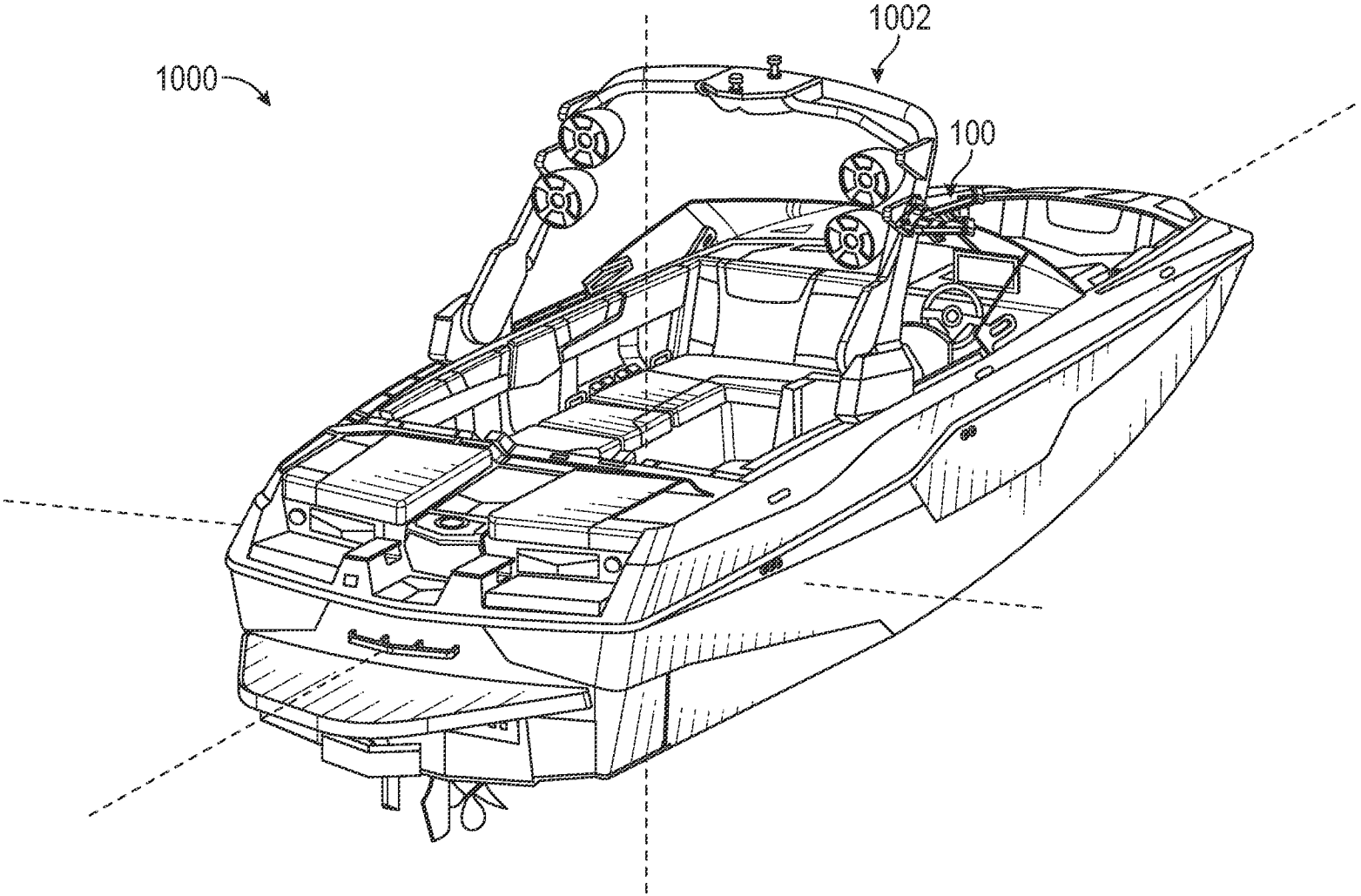
FIG. 1A illustrates an example power boat with a sport board rack.

FIG. 1A illustrates an example power boat (e.g., water sports boat, watercraft, boat, watercraft) 1000 with a board rack 100. The board rack 100, as disclosed herein, can be used to securely hold one or more boards, which can at least include wakeboards and surfboards. In some embodiments, the board rack 100 can hold skis, paddle boards, boogie boards, foil boards (e.g., foil surfboards), electric foil boards, snowboards, and/or other sport boards. The board rack 100 can be coupled to the tower 1002 of the boat 1000. The board rack 100 can be coupled to the outside of the tower 1002 of the boat 1000 to free up deck space and head space. The board rack 100 can be coupled to another portion of the boat 1000. The board rack 100 can be rotatably coupled to the tower 1002 and/or other portion of the boat 1000.

Figure 1B:
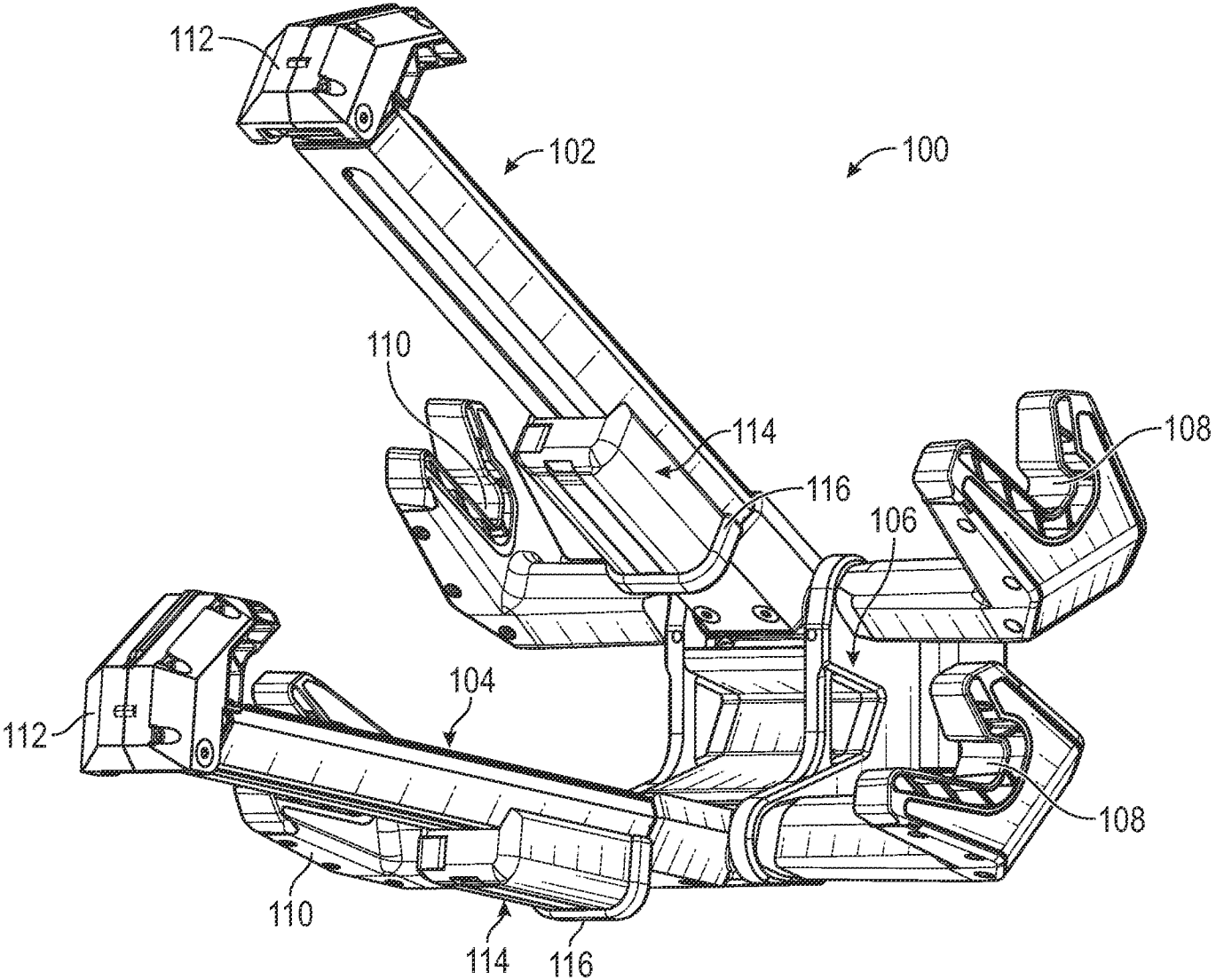
FIG. 1B illustrate the sport board rack with two telescoping arms retracted and claws closed.

FIG. 1B illustrates the board rack 100, which can also be referred to as a sport board rack or gear rack. The board rack 100 can include one or more arms, which can at least include the first arm assembly 102 and/or second arm assembly 104. The first arm assembly 102 and/or second arm assembly 104 can be rotatably (e.g., pivotably) mounted to a base 106 of the board rack 100 such that the first arm assembly 102 and second arm assembly 104 can pivot (e.g., rotate) relative to each other. The angle between the first arm assembly 102 and/or second arm assembly 104 can be adjusted by way of pivoting the first arm assembly 102 and/or second arm assembly 104. The angle between the first arm assembly 102 and second arm assembly 104 can adjusted to be less than 10, 20, 30, 40, 50, 60, 70, 80, 90, or more than 90 degrees or any angle between any of the foregoing. The first arm assembly 102 and/or second arm assembly 104 can be telescoping arms such that the first arm assembly 102 and/or second arm assembly 104 can be extended to lengthen the first arm assembly 102 and/or second arm assembly 104 or retracted to shorten the first arm assembly 102 and/or second arm assembly 104. The extension and retraction of the first arm assembly 102 and/or second arm assembly 104 can facilitate securing boards of different sizes and shapes on the board rack 100. As illustrated in FIG. 1B, the first arm assembly 102 and/or second arm assembly 104 are in the retracted position.

The first arm assembly 102 and/or second arm assembly 104 can include a claw 112, which can also be referred to as a hook, finger, and/or articulating claw. The claw 112 of each of the first arm assembly 102 and/or second arm assembly 104 can cooperate with a seat 108 and seat 110 to hold a board therebetween. The claw 112, seat 108, and seat 110 can provide three points of contact to securely hold a board in place. The claw 112, seat 108, and/or seat 110 can include a deformable material (e.g., polymer) that contacts a board to prevent damage and/or provide a more secure contact between the claw 112, seat 108, and/or seat 110 and the retained board. The seat 108 and seat 110 corresponding to the first arm assembly 102 can pivot (e.g., rotate) with the first arm assembly 102 relative to the base 106. The seat 108 and seat 110 corresponding to the second arm assembly 104 can pivot (e.g., rotate) with the second arm assembly 104 relative to the base 106. The seat 108 and/or seat 110 can include forks with two prongs to hold a board.

Figure 2:
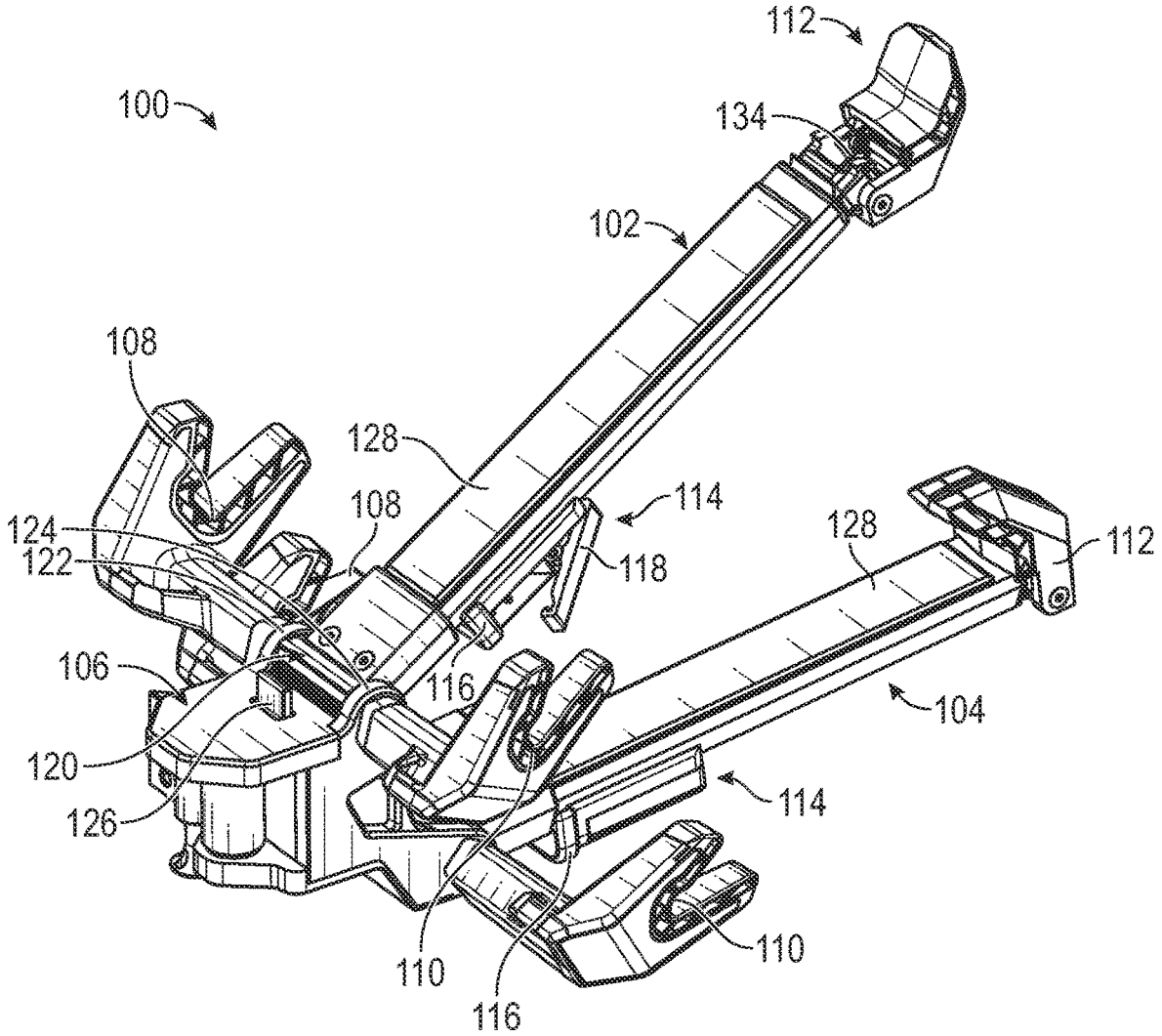
FIG. 2 illustrates the sport board rack with one claw open.

The first arm assembly 102 and/or second arm assembly 104 can include an housing 114, which can also be referred to as a slide, slider, bracket, and/or positioner. The housing 114 can include a button 116, which may also be referred to as a release, release button, or switch. As shown in FIG. 2, the button 116 can be pushed to open the claw 112, which can case positioning of a board on the seat 110 and seat 108. When the button 116 is pushed, a lever 118 can be deployed or released from the housing 114. The lever 118 can be positioned (e.g., rotated) back into the housing 114 to close the claw 112. The lever 118 can be coupled with a cable 134 coupled with the claw 112 such that the positioning of the lever 118 back into the housing 114 pulls the cable 134 to rotate the claw 112 back to a closed position.

The first arm assembly 102 and/or second arm assembly 104 can include a pad 128. The pad 128 can be positioned to contact a surface of the board when the board is positioned on the board rack 100. The pad 128 can be made of a deformable material, such as a polymer, to prevent damage to a board held by the board rack 100.

The first arm assembly 102 and/or second arm assembly 104 can each be coupled to a shaft assembly 120. The shaft assembly 120 can be coupled to corresponding seat 108 and seat 110 such that the first arm assembly 102 and/or second arm assembly 104 pivot (e.g., rotate) with corresponding seats 108 and seats 110. The shaft assembly 120 can extend through flanges 122 and flanges 124 of the base 106.

The base 106 can include a lever 126. The lever 126 can interact with the shaft assembly 120 to lock the shaft assembly 120 in a rotated position, which can lock the corresponding first arm assembly 102, seat 108, and seat 110 in the rotated position. The lever 126 can lock the shaft assembly 120 associated with the first arm assembly 102 while another lever, as described herein, can lock the shaft assembly 120 associated with the second arm assembly 104. The lever 126 can be manipulated to enable the shaft assembly 120 and corresponding first arm assembly 102 to rotate and released to lock the shaft assembly 120 and corresponding first arm assembly 102 in a position. Similarly, another lever can be manipulated to enable the shaft assembly 120 and corresponding second arm assembly 104 to rotate and released to lock the shaft assembly 120 and corresponding second arm assembly 104 in a position.

Figure 3:
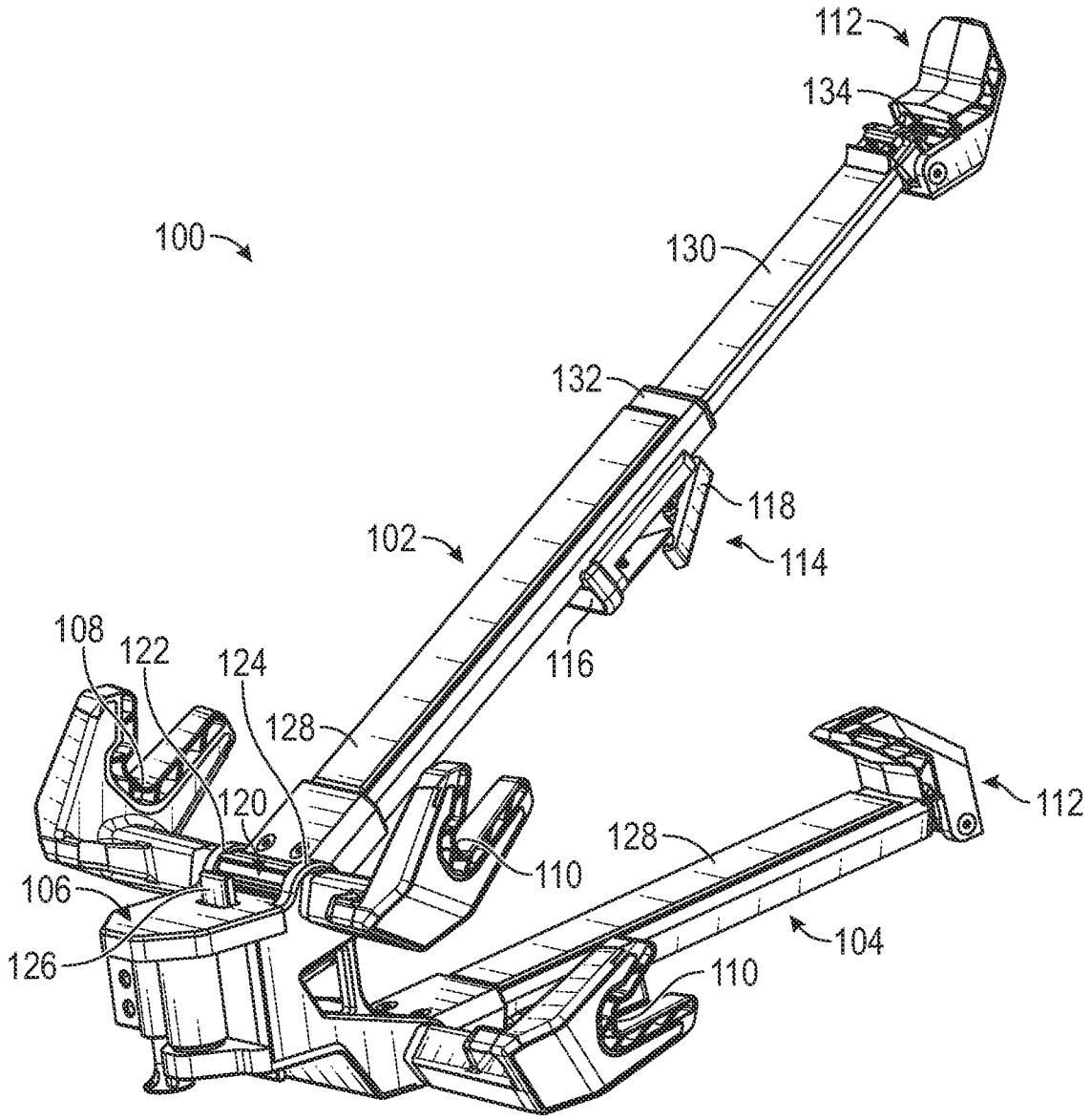
FIG. 3 illustrates the sport board rack with one telescoping arm extended and the one claw open.

With the claw 112 open, the housing 114 can be translated (e.g., pushed) away from the base 106, seat 108, and/or seat 110 to extend the first arm assembly 102 and/or second arm assembly 104, as shown in FIG. 3. An inner arm 130 of the first arm assembly 102 can be extended from inside an outer arm 132 of the first arm assembly 102 to move the claw 112 away from the base 106, seat 108, and/or seat 110. As the inner arm 130 is extended, the inner arm 130 can be locked in the extended position by an internal pawl and ratchet system, which is described herein. The extension of the first arm assembly 102 and/or second arm assembly 104 can facilitate receiving a wider board for securement.

Figure 4:
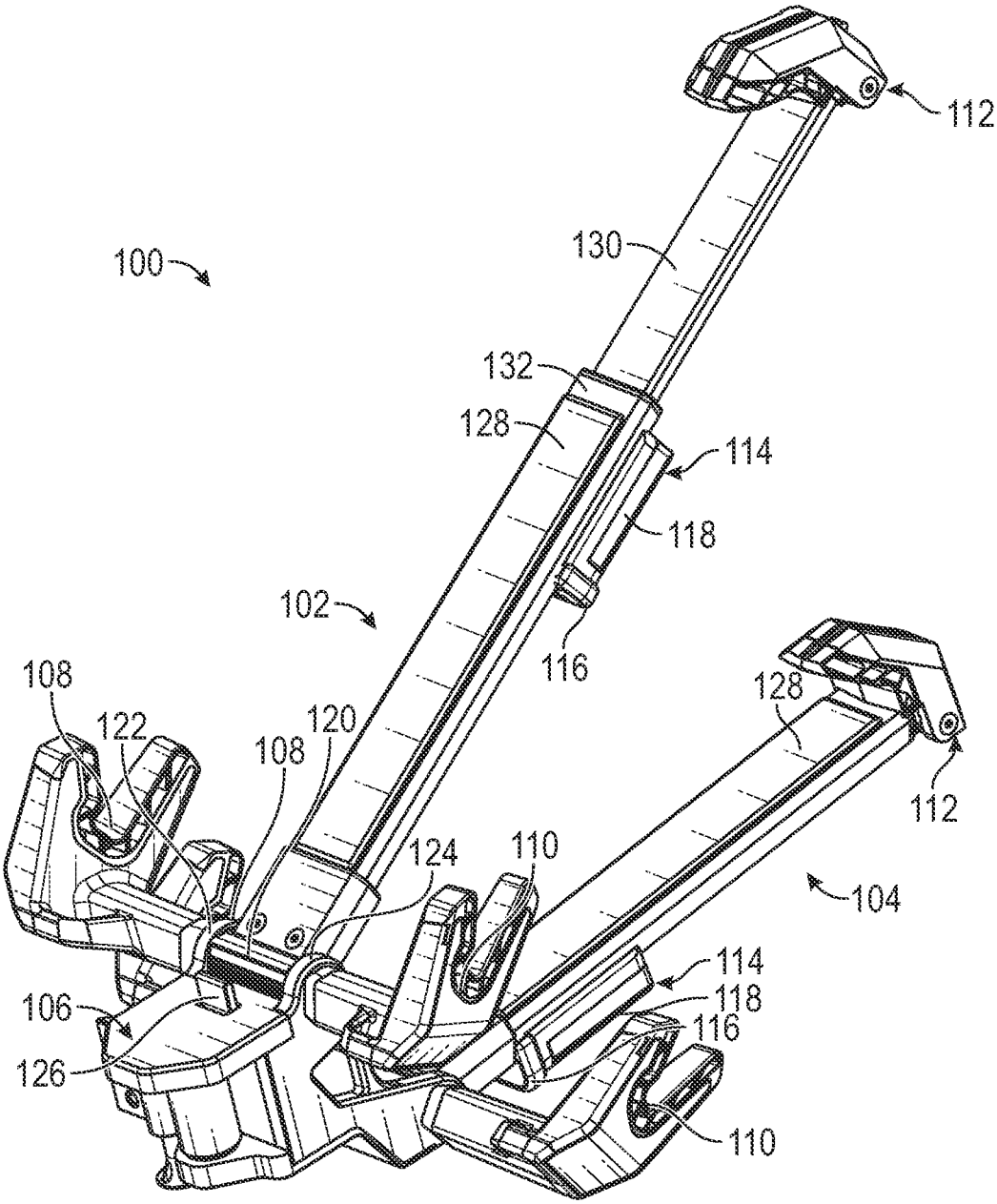
FIG. 4 illustrates the sport board rack with the one telescoping arm extended and the one claw closed.

As shown in FIG. 4, the lever 118 can be positioned (e.g., rotated) back into the housing 114 to close (e.g. rotate down) the claw 112. As described herein, the lever 118 can be coupled (e.g., tethered) to the claw 112 such that rotating the lever 118 back into the housing 114 pulls the claw 112 to a closed position. The housing 114 can be translated (e.g., pulled) toward the base 106, seat 108, and/or seat 110 to secure (e.g., clamp) a board between the claw 112, seat 108, and/or seat 110. In some embodiments, the claw 112 does not rotate, but instead, is fixed relative to the inner arm 130 such that the claw 112 remains in the closed positioned as the first arm assembly 102 and/or second arm assembly 104 are extended and/or retracted. The inner arm 130 can be locked in the retracted position by the internal pawl and ratchet system.

Figure 5A:
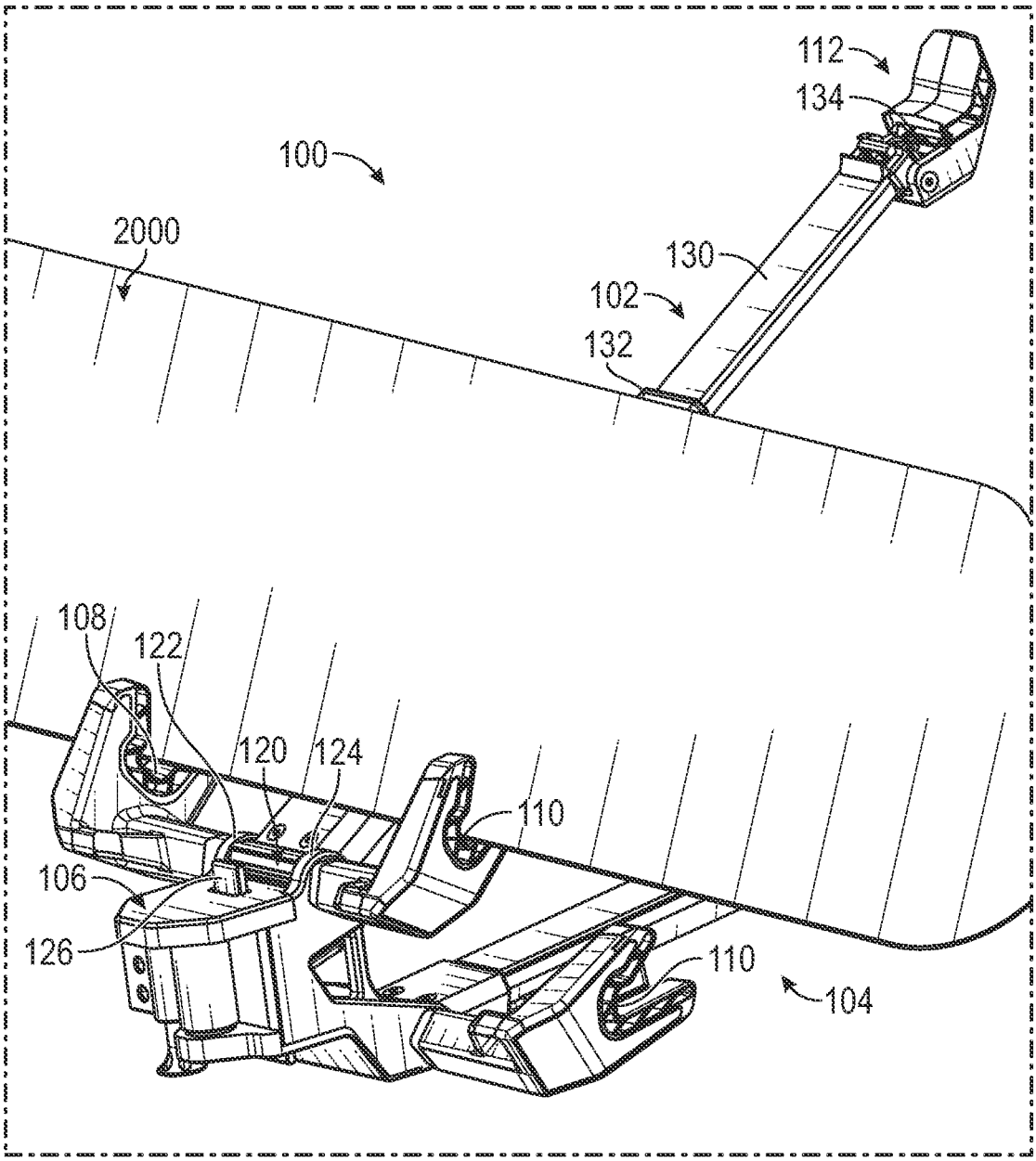
FIG. 5A illustrates the sport board rack with one telescoping arm extended and the one claw open with a sport board placed in the sport board rack.
Figure 5B:
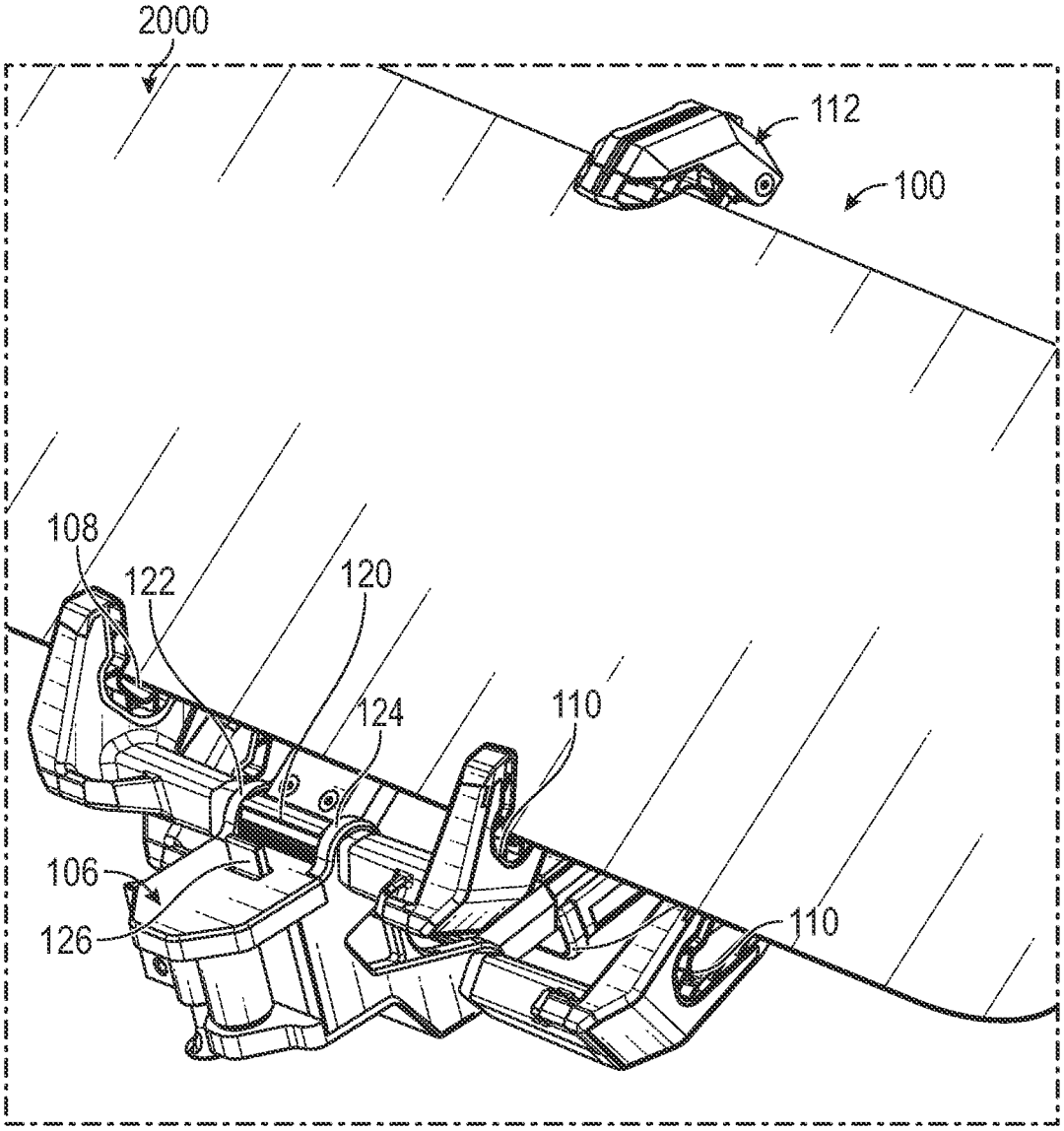
FIG. 5B illustrates the sport board rack with the one telescoping arm retracted to secure the sport board between the one closed claw and seats of the sport board rack.

FIG. 5A illustrates a board 2000 positioned on the seat 108 and seat 110 corresponding with the first arm assembly 102 during the stowage process. The board 2000 may be contacting the pad 128 disposed on the outer arm 132 of the first arm assembly 102. FIG. 5B illustrates the claw 112 having been translated toward the base 106, seat 108, and/or seat 110 to secure (e.g., clamp) the board 2000 between the claw 112, seat 108, and seat 110. As described herein, the articulation of the claw 112 can provide of case of loading the board 2000 onto the board rack 100. Additionally, the telescoping of the first arm assembly 102 and/or second arm assembly 104 can enable boards of varying sizes and shapes to be secured within the board rack 100.

The board rack 100 can be used to secure multiple boards at the same time. For example, the first arm assembly 102 can be used to secure a first board while the second arm assembly 104 can be used to simultaneously secure a second board. In some variants, the board rack 100 can be modular to incorporate one, two, three, four, five, six, or more telescoping arms with corresponding seats to hold a plurality of boards.

Figure 6:
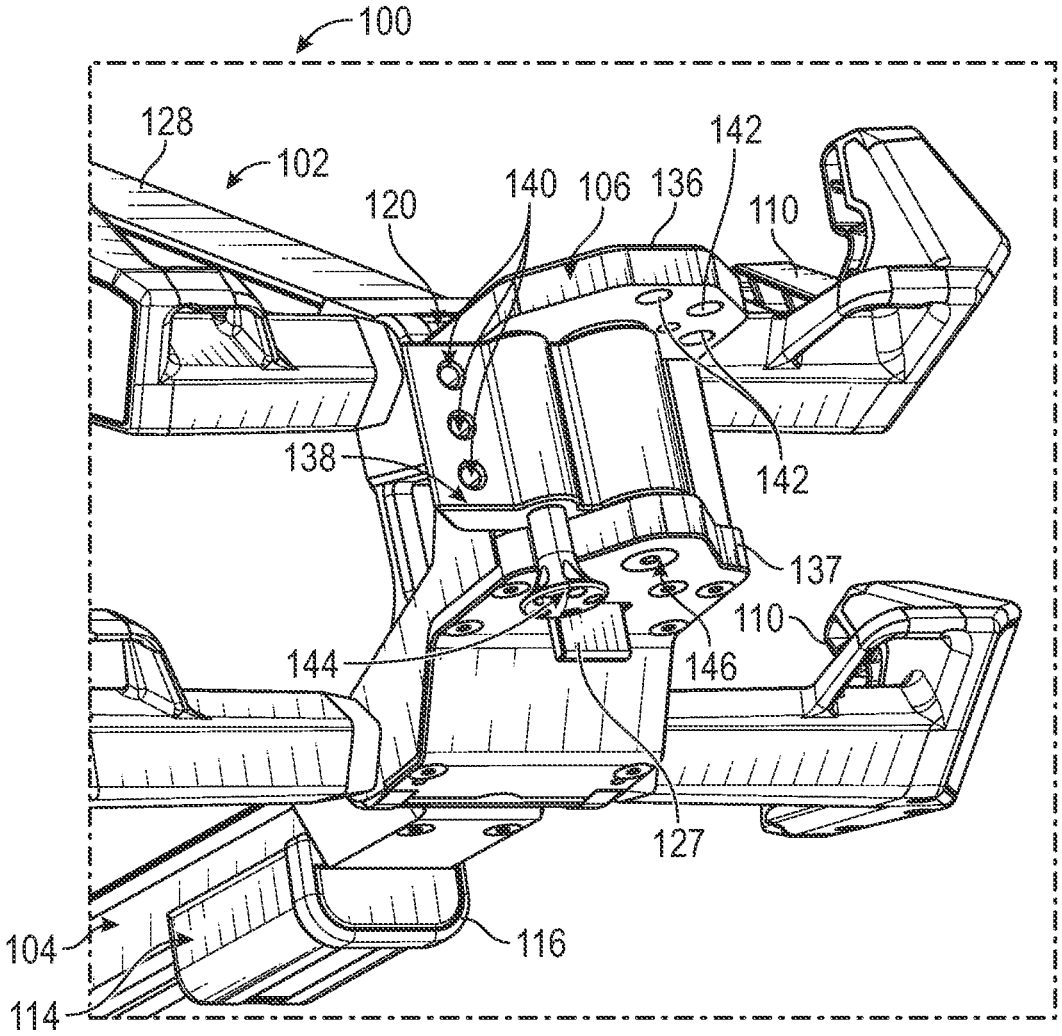
FIG. 6 illustrates the base of the sport board rack, which may be coupled to the power boat.

FIG. 6 illustrates a view of the base 106, which can also be referred to as a frame and/or mount. The base 106 can include a lever 127, which can be similar to the lever 126. The lever 127 can engage a shaft assembly 120 corresponding to the second arm assembly 104, seat 108, and seat 110 to lock the shaft assembly 120 and corresponding second arm assembly 104, seat 108, and seat 110 in a pivoted position. The lever 126 and/or lever 127 can be biased by a spring (e.g., torsion spring) to lock the shaft assemblies 120 in a rotated position.

The base 106 can include a flange 136 and a flange 137. The flange 136 and flange 137 can be spaced apart from each other. The flange 136 and flange 137 can be parallel to each other. A flange 138 can be oriented perpendicular relative to the flange 136 and flange 137. The flange 138 can be rotatably coupled to the flange 136 and flange 137. The flange 138 can be coupled to a portion (e.g., tower 1002) of the power boat 1000 or other vehicle to rotatably mount the board rack 100 thereon. The flange 138 can include one or more holes 140 to facilitate coupling. The flange 138 can include a pin 144. The pin 144 can be biased by a spring to insert the pin 144 in one of the holes 142 disposed in the flange 136 to lock the flange 138 at a rotated position.

Figure 7:
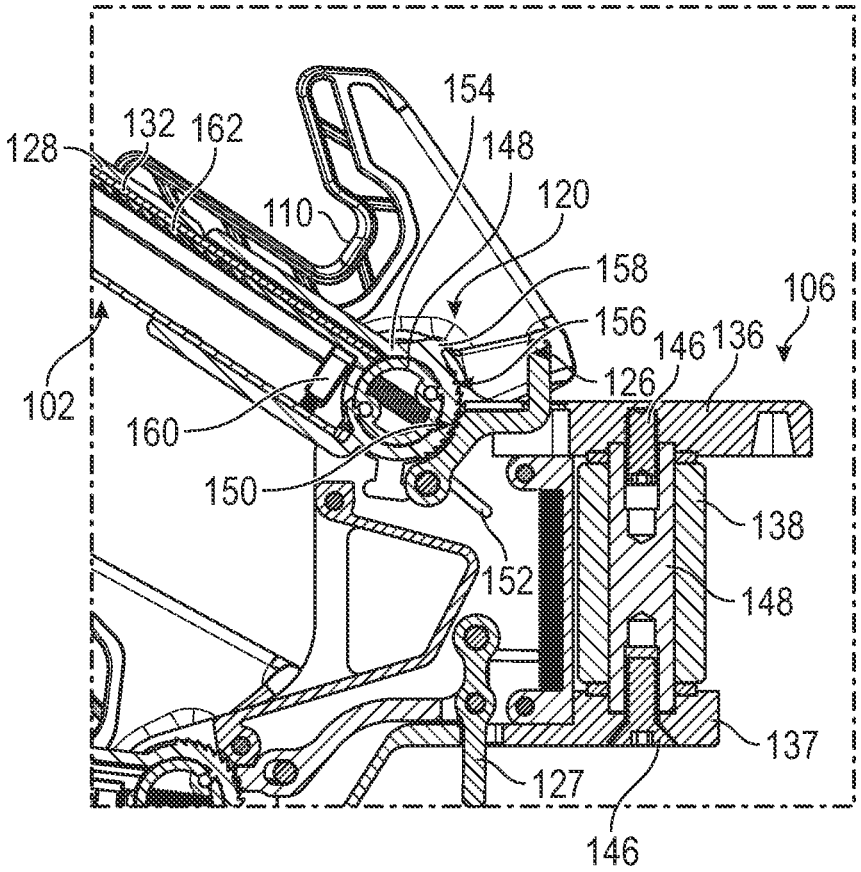
FIG. 7 illustrates a section view of at least a portion of the base of the sport board rack.

As shown in FIG. 7, a shaft 148 can extend through the flange 138 to facilitate rotatable coupling with the flange 136 and flange 137 such that the flange 138 rotates about the shaft 148. Screws 146 can couple the shaft 148 to the flange 136, flange 137, and/or flange 138.

The shaft assembly 120 corresponding to the first arm assembly 102 can include a mount 154, which can also be referred to as a base. The mount 154 can receive an end portion of the outer arm 132 therein. The mount 154 can receive an end portion of a toothed insert 162, which can also be referred to as a ratchet insert. The mount 154 can be rigidly coupled to a shaft 148 of the shaft assembly 120. The shaft 148 can be rigidly coupled to the seat 108 and seat 110 such that rotation of the mount 154 causes rotation of the seat 108 and seat 110 corresponding to the first arm assembly 102. The mount 154 can include teeth 156 that engage with teeth 150 of the lever 126 to prevent rotation of the shaft assembly 120. As described herein, a spring, such as a torsion spring, can bias the teeth 150 of the lever 126 into the teeth 156 of the mount 154 to lock the mount 154 and shaft 148 in a rotated position. The spring can be disposed in a spring receiver 152 of the base 106. The mount 154 can include a protrusion 158, which can also be described as a catch. The protrusion 158 can prevent the mount 154 from rotating in a direction. The lever 126 can be manipulated by the user to disengage the teeth 150 of the lever 126 from the teeth 156 of the teeth 156 to permit rotation of the mount 154 and first arm assembly 102.

The second arm assembly 104 can be coupled to the base 106 in the same or similar manner as the first arm assembly 102.

Figure 8:
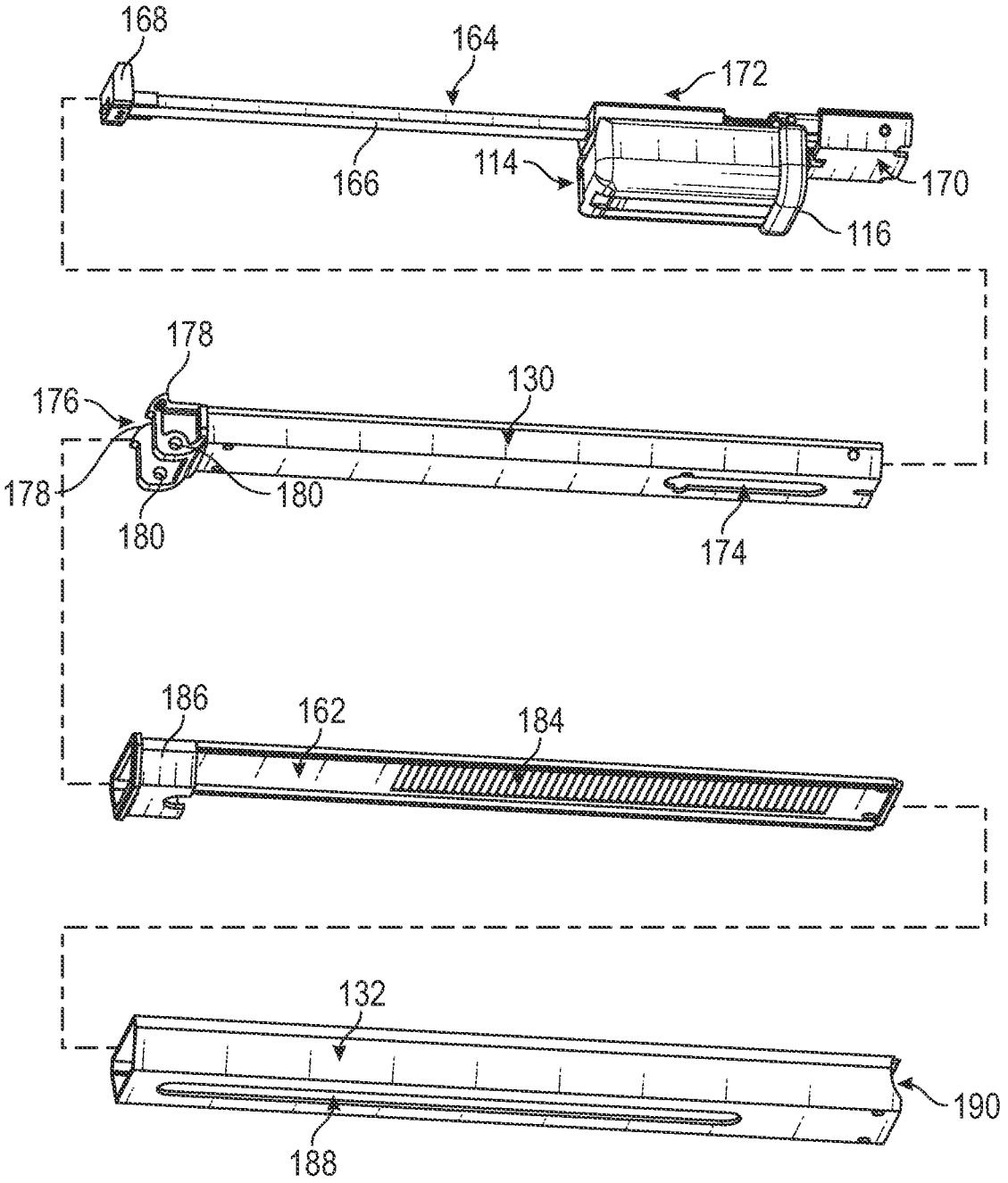
FIG. 8 illustrates an exploded view of at least some of the components of a telescoping arm of the sport board rack.

FIG. 8 illustrates an exploded view of at least some of the components of the first arm assembly 102. The second arm assembly 104 can include the same components. As described herein, the first arm assembly 102 can include an outer arm 132. The outer arm 132 can be a tube having an interior. The outer arm 132 can have a curved ending 190. The curved ending 190 can contact the shaft 148 of the shaft assembly 120. The outer arm 132 can include an opening 188. The opening 188 can be elongate and/or have rounded ends. The opening 188 can allow the housing 114 to remain coupled to a bolt 172 as the inner arm 130 and bolt 172 housed within the inner arm 130 slide within the outer arm 132.

The first arm assembly 102 can have a toothed insert 162, which can also be referred to as a ratchet insert. The toothed insert 162 can include a mount 186 to secure the toothed insert 162 to the outer arm 132. The mount 186 can couple to an end of the outer arm 132 opposite the curved ending 190. In some variants, the toothed insert 162 can be fixed relative to the outer arm 132 with a fastener, such as a plug, pin, and/or screw. In some variants, an inner surface of the outer arm 132 can include the teeth 184. The teeth 184 can engage with a pawl to lock the inner arm 130 and claw 112 in a position. The toothed insert 162 can be fixedly attached to the outer arm 132.

The first arm assembly 102 can include an inner arm 130. The inner arm 130 can be a tube having an interior. The inner arm 130 can include an opening 174, which can be elongate. The opening 174 can allow the bolt 172 to be coupled to the housing 114. A base 176, which can also be referred to as a mount, can be disposed at an end of the inner arm 130. The claw 112 can be rotatably coupled to the base 176. The base 176 can include a hole 180 extending therethrough. A pin can be inserted through the hole 180 and claw 112 to rotatably couple the claw 112 to the base 176. The base 176 can include flanges 178 that can retain a locking pin of the claw 112 to hold the claw 112 in the closed position. The flanges 178 can include hooks and/or curved surfaces to hold the locking pin.

Figure 9:
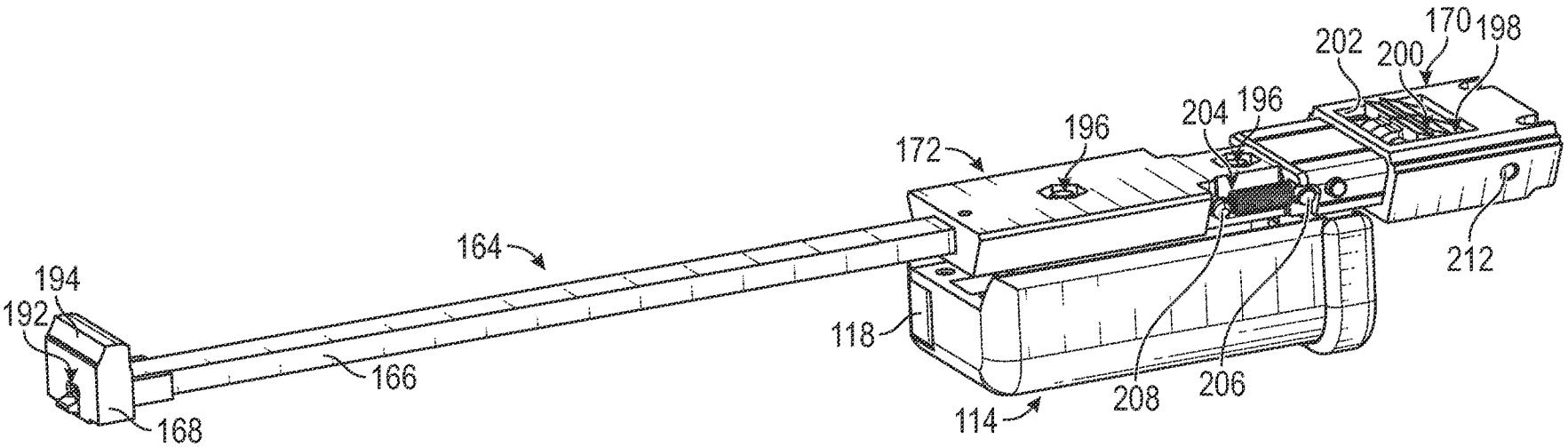
FIG. 9 illustrates at least some internal components of the telescoping arm of the sport board rack.

The first arm assembly 102 can include a carrier 170, as shown in FIG. 9. The carrier 170 can be disposed outside of and proximate the inner arm 130. The carrier 170 can contact an end of the inner arm 130. The carrier 170 can carry a pawl 198. The pawl 198 can include teeth 200 that can engage with the teeth 184 of the toothed insert 162 to lock the carrier 170, bolt 172, inner arm 130, and/or claw 112 in an extended or retracted position. The teeth 200 of the pawl 198 can extend through an opening 202 in the carrier 170 to engage the teeth 184 of the toothed insert 162. The pawl 198 can be rotatably mounted on a pin 212. The pawl 198 can be biased to extend the teeth 200 through the opening 202 to engage the teeth 184 of the toothed insert 162 by a spring, such as a torsion spring.

The first arm assembly 102 can include a bolt 172, which can also be referred to as a block or slider. The bolt 172 can be coupled to the carrier 170 with one or more springs 204 or the like such that the carrier 170 can be pulled by movement of the bolt 172. The carrier 170 can include one or more pins 206. The bolt 172 can include one or more pins 208. One or more springs 204 can couple the pin(s) 206 and the pin(s) 208. The bolt 172 can be disposed inside of the inner arm 130. The bolt 172 can be coupled to the housing 114 through the opening 174 of the inner arm 130 and opening 188 of the outer arm 132 such that the actuator 114 is disposed outside of the outer arm 132. The bolt 172 can be coupled to the housing 114 by screws 196.

The first arm assembly 102 can include a ram 164, which can also be referred to as a pusher. The ram 164 can be disposed in the inner arm 130. The ram 164 can be rigidly mounted to the bolt 172. The ram 164 can include a tube 166, which can also be referred to as a rod or shaft. The ram 164 can include a head 168. The head 168 can be disposed on an end of the ram 164. The head 168, as described herein, can push the lock pin of the claw 112 out from under the flanges 178 of the base 176 attached to the inner arm 130 to allow the claw 112 to open by way of a spring, such as a torsion spring. A cable or the like can extend through the tube 166 of the ram 164 and out of an opening 192 in the head 168 to couple with the claw 112 such that rotation of the lever 118, as described herein, can close (e.g., rotate down) the claw 112.

Figure 10A:
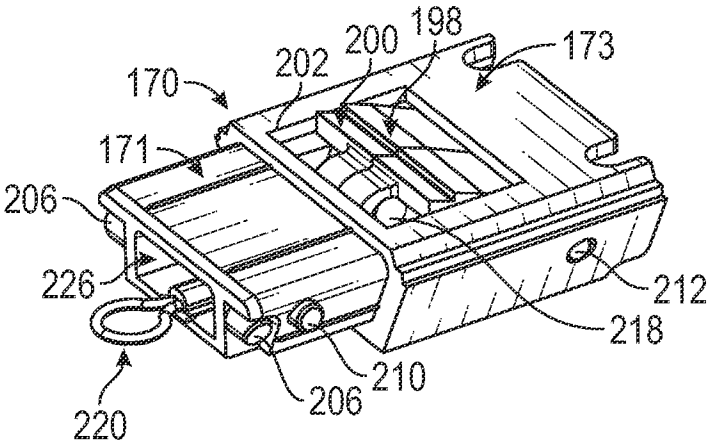
FIGS. 10A, 10B, 10C, and 10D illustrate various views of the carrier, pawl, and related components.
Figure 10B:
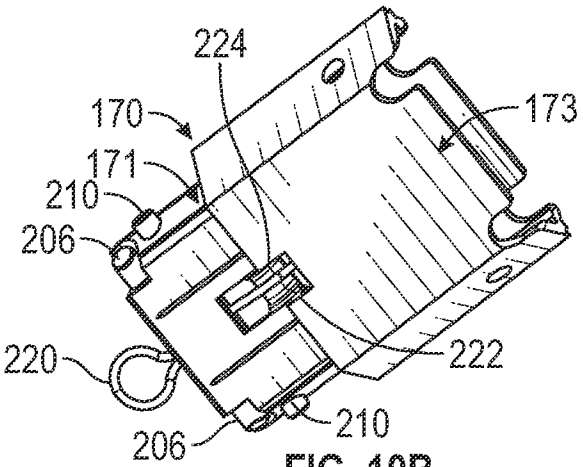
Figure 10C:
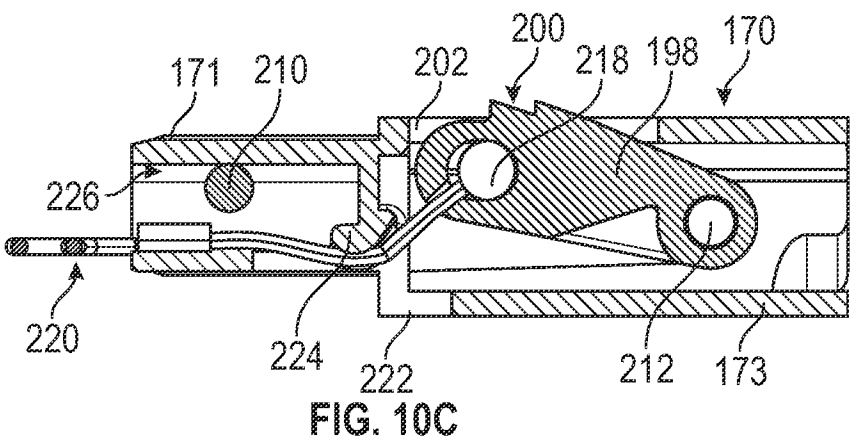
Figure 10D:
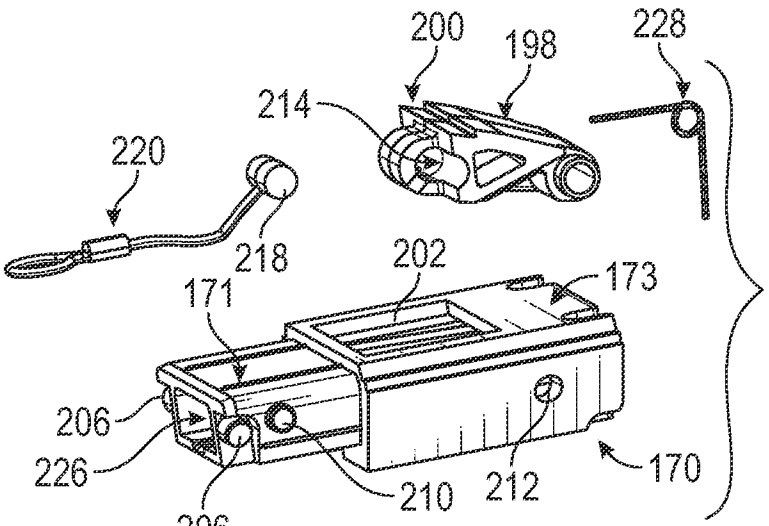

FIGS. 10A-10C illustrate various views of the carrier 170. The carrier 170 can house a pawl 198. The pawl 198 can be rotatably mounted inside the carrier 170 at a pin 212. For example, the pin 212 can extend through a hole 216 of the pawl 198. The pawl 198 can be biased by a spring 228, which can be a torsion spring, to extend through an opening 200 in the carrier 170 such that teeth 200 of the pawl 198 extend through the opening 200 to engage with the teeth 184 of the toothed insert 162. The pawl 198 can be coupled with a cable 220 or the like. An end portion 218 of the cable 220 can be coupled to the pawl 198. For example, the end portion 218 can be inserted into a hole 214 in the pawl 198. The hole 214 can be disposed on an opposite side of the pawl 198 relative to the hole 216 such that the pulling of the cable 220 creates a larger torque on the pawl 198 to rotate the pawl 198 away from the teeth 200 of the pawl 198.

The cable 220 can extend through an interior of the carrier 170. For example, the cable 220 can extend from the pawl 198 to around a guide 224, which can also be referred to as a protrusion, and out the carrier 170 by way of an opening 226. Because of the contact between the guide 224 and the cable 220, the pulling of the cable 220 through the opening 226 can pivot the pawl 198 downward and away from the teeth 184 of the toothed insert 162. The cable 220 can be coupled to the bolt 172. For example, the cable 220 can include a loop, which can be opposite the end 218, that can be wrapped around a protrusion 268 or pin of the bolt 172. The carrier 170 can include an opening 222. The opening 222 can be positioned below the guide 222, which can enable a technician to access the cable 220 disposed in the carrier 170. The carrier 170 can include a pin 210.

The carrier 170 can include a front portion 171, which can also be referred to as a leading portion, and a rear portion 173, which can also be referred to as a trailing portion. The front portion 171 can be inserted into the inner arm 130. The rear portion 173 can contact an end portion of the inner arm 130 and be positioned outside the inner arm 130 but within the outer arm 132. The front portion 171 can include an outer periphery that corresponds to an inner periphery of the inner arm 130. The rear portion 173 can include an outer periphery that corresponds to an inner periphery of the outer arm 132.

Figure 11:
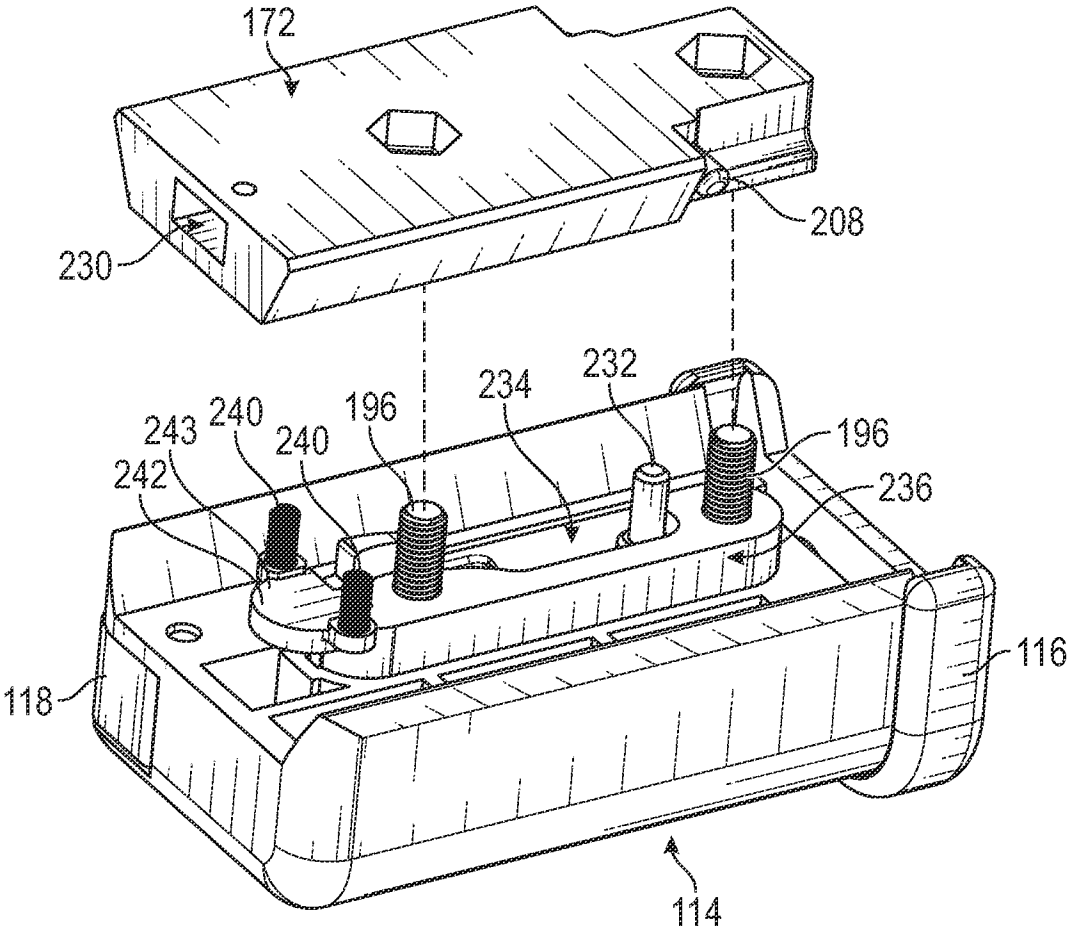
FIG. 11 illustrates a partially exploded view of the housing and the bolt.

FIG. 11 illustrates a partially exploded view of the bolt 172 and housing 114. As described herein, the bolt 172 can be disposed within the inner arm 130 and the housing 114 can be disposed outside the inner arm 130 and outer arm 132. The bolt 172 can include an outer periphery that corresponds to an inner periphery of the inner arm 130. The bolt 172 and housing 114 can be rigidly coupled together, which can be by way of the screws 196. The housing 114 can include a protrusion 236 that extends to contact the bolt 172. The protrusion 236 can extend through the opening 188 of the outer arm 132 and the opening 174 of the inner arm 130. The housing 114 can include a rod 232, which can also be referred to as a member, pin, and/or bar. The rod 232 can be linked to the lever 118 such that the movement of the rod 232 corresponds to the movement of the lever 118.

Figure 12:
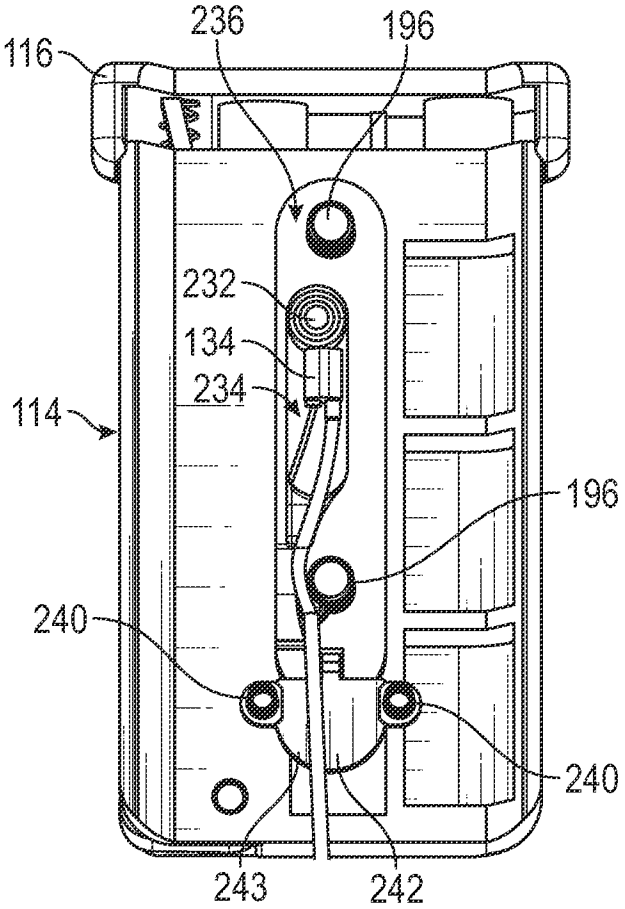
FIG. 12 illustrates the housing.

As shown in FIG. 12, the cable 134 coupled to the claw 112 can be coupled to the rod 232 such that the lever 118 can be manipulated (e.g., rotated into the housing 114) to pull the cable 134 to move (e.g., rotate, articulate) the claw 112 to the closed position. The cable 134 can exit the bolt 172 by way of an opening 230 and extend through the tube 166 of the ram 164 to couple with the claw 112. The rod 232 can move within a slot 234 of the housing 114.

The bolt 172 can include an interference member 242, which can also be referred to as a stop or block. The interference member 242 can include a head 243 that can be configured to contact a periphery of the opening 174 of the inner arm 130 to prevent relative movement between the inner arm 130 and the bolt 172 and/or at least advancement of the bolt 172 relative to the inner arm 130 away from the base 106. The head 243 can have a curved leading periphery. Springs 240 can bias the head 243 of the interference member 242 in a direction (e.g., down) to contact a periphery of the opening 174 of the inner arm 130 to prevent advancement of the bolt 172 relative to the inner arm 130. The biasing force of the springs 240 can be overcome such that the head 243 of the interference member 242 is translated toward the bolt 172 and out of contact with the periphery of the opening 174 of the inner arm 130, which can enable the bolt 172 to be translated within the inner arm 130 a distance before a member of the interference member 242 contacts the periphery of the opening 174 of the inner arm 130 such that the movement, or at least advancement away from the base 106, seat 108, and/or seat 110 of the bolt 172 and the inner arm 130 are once again tied together. The movement of the bolt 172 a distance relative to the inner arm 130 can advance the ram 164 within the inner arm 130 to move a lock pin of the claw 112, allowing a torsion spring of the claw 112 to rotate the claw 112 open. The button 116 of the housing 114 can be pushed to release the lever 118 and push the head 243 out of contact with the periphery of the opening 174 of the inner arm 130 to advance the bolt 172 a distance relative to the inner arm 130 to advance the ram 164 to unlock the claw 112, as described herein.

Figure 13A:
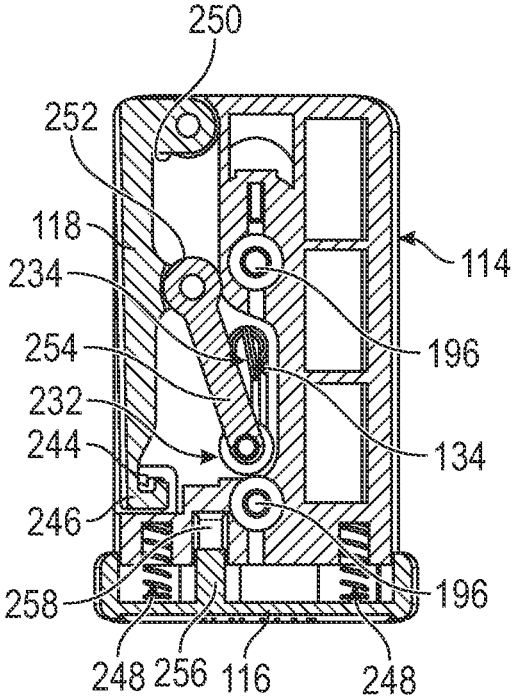
FIGS. 13A and 13B illustrate section views of the housing.
Figure 13B:
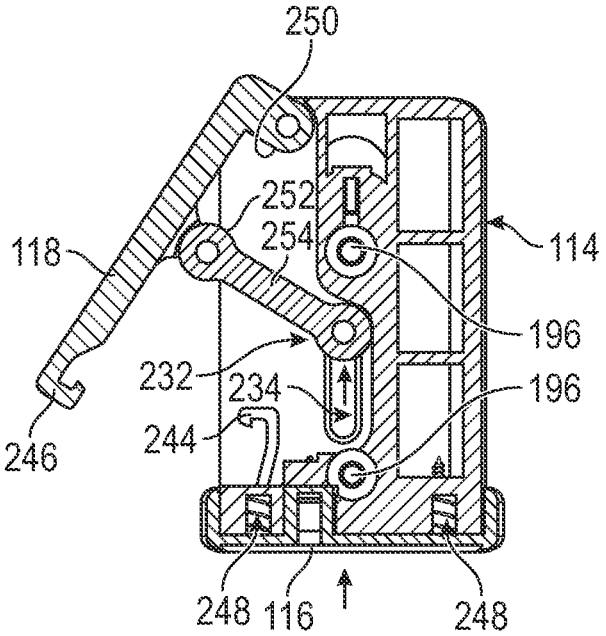

FIGS. 13A and 13B illustrate section views of the housing 114. As illustrated, the housing 114 can include a link 254 (e.g., member, arm) coupled, which can include rotatably coupled, to the rod 232. The link 254 can be rotatably coupled to the lever 118 at a joint 252. The joint 252 can be disposed at a middle portion of the lever 118. The lever 118 can be rotatably coupled to the housing 114 at a joint 250. The lever 118 can include a hook 246, which can also be referred to as a catch. The hook 246 can be disposed on an end of the lever 118. The button 116 can include a hook 244, which can also be referred to as a catch. The hook 244 can engage with the hook 246 of the lever 118 to retain the lever 118 within the housing 114, as shown in FIG. 13A. The button 116 can be biased by way of spring(s) 248 to secure the engagement between the hook 244 of the button 116 and the hook 246 of the lever 118. The button 116 can include a protrusion 256 that can slide within a slot 258 of the housing 114 to help keep the button 116 and housing 114 aligned. The user can push the button 116 and overcome the biasing force of the springs 248 to disengage the hook 244 of the button 116 from the hook 246 of the lever 118, as shown in FIG. 13B.

As described herein, the rod 232 can be coupled to a cable 134 coupled to the claw 112. Accordingly, when the hook 244 and hook 246 are disengaged and the head 243 of the interference member 242 is cleared of the periphery of the opening 174 to advance the bolt 172 and ram 164 to move a lock pin of the claw 112 by way of pushing the button 116, a spring (e.g., torsion spring) of the claw 112 can rotate the claw 112 open to pull the cable 134 to translate the rod 232 within the slot 234 to move the link 254 and deploy (e.g., rotate out) the lever 118, as illustrated in FIG. 13B. Accordingly, FIG. 13A corresponds to the configuration of the housing 114 with the claw 112 in the closed position, and FIG. 13B corresponds to the configuration of the housing 114 with the claw 112 in the open position.

Figure 13D:
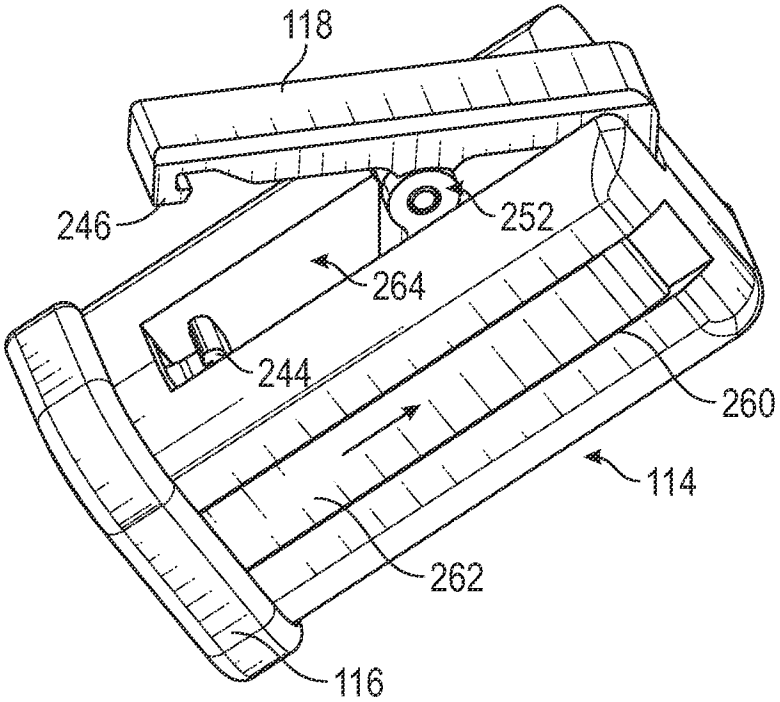
FIG. 13D illustrates the housing with the button pressed and lever released.
Figure 13C:
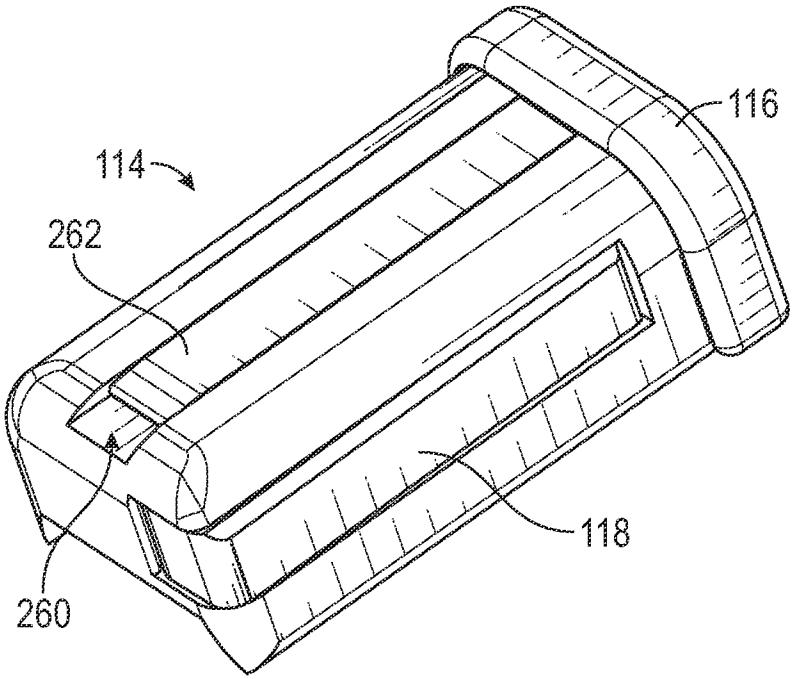
FIG. 13C illustrates the housing.

FIG. 13C illustrates the configuration of the housing 114 with the claw 112 in the closed position. As shown, the lever 118 can be disposed within the housing 114. The button 116 can include a tongue 262 that is disposed within a channel 260 of the housing 114. The tongue 262 can be rigidly connected with the button 116 such that advancement of the button 116 can correspond with advancement of the tongue 262 within the channel 260.

FIG. 13D illustrates the configuration of the housing 114 with the button 116 pushed. As shown, the tongue 262 has been advanced within the channel 260 of the housing 114. The tongue 262 can include a flange, which, as described herein, can include a curved or angled surface. As the tongue 262 is advanced, the flange of the tongue 262 can contact the interference member 242 and push the interference member 242 against the biasing of the springs 240 to clear the head 243 of the interference member 242 of the periphery of the opening 174. With the hook 244 and hook 246 disengaged, the bolt 172 can then advance a distance relative to the inner arm 130 to move the ram 164 relative to the inner arm 130 to move a lock pin of the claw 112, allowing a spring (e.g., torsion spring) of the claw 112 to rotate the claw 112 open. The rotation open of the claw 112 can pull the cable 134 coupled to the rod 232 to rotate the lever 118 out of the housing 114.

Figure 14A:
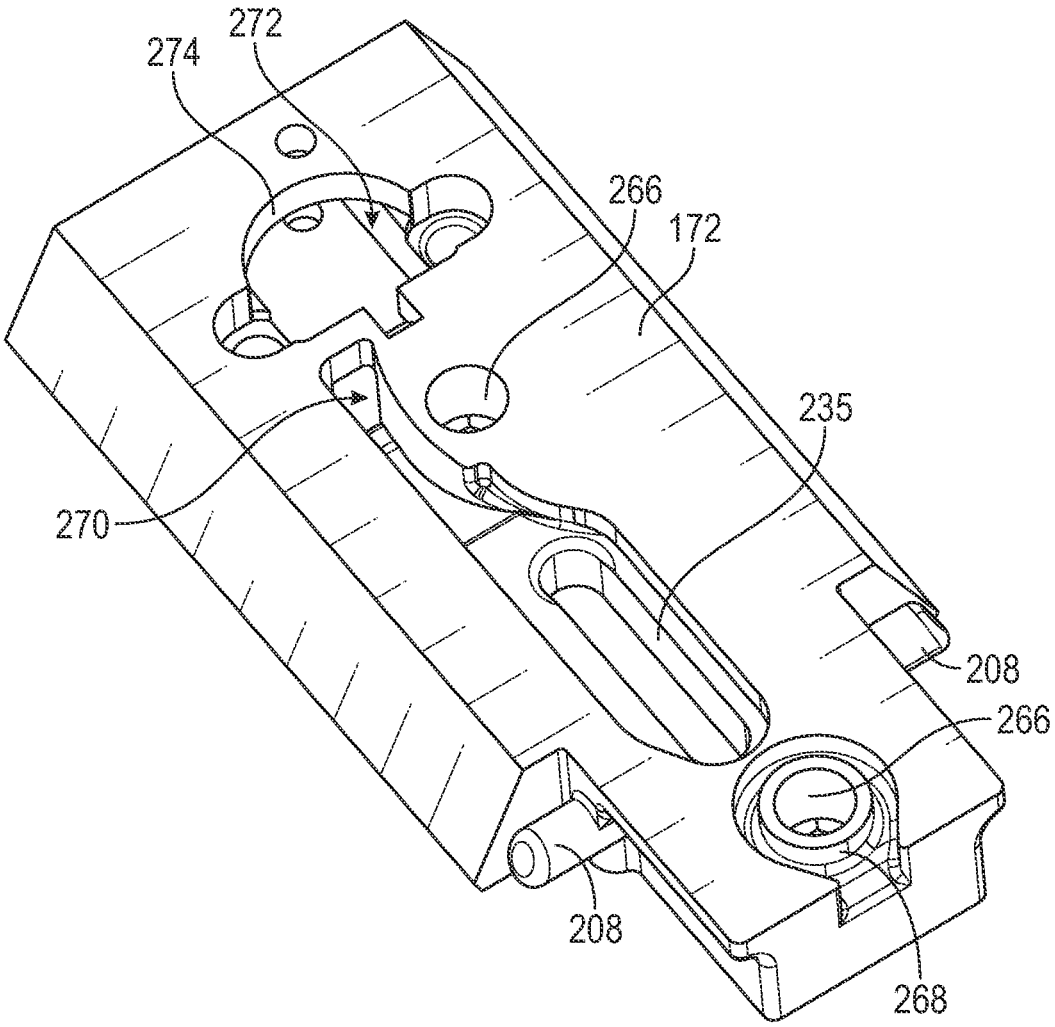
FIGS. 14A and 14B illustrate various views of the bolt.
Figure 14B:
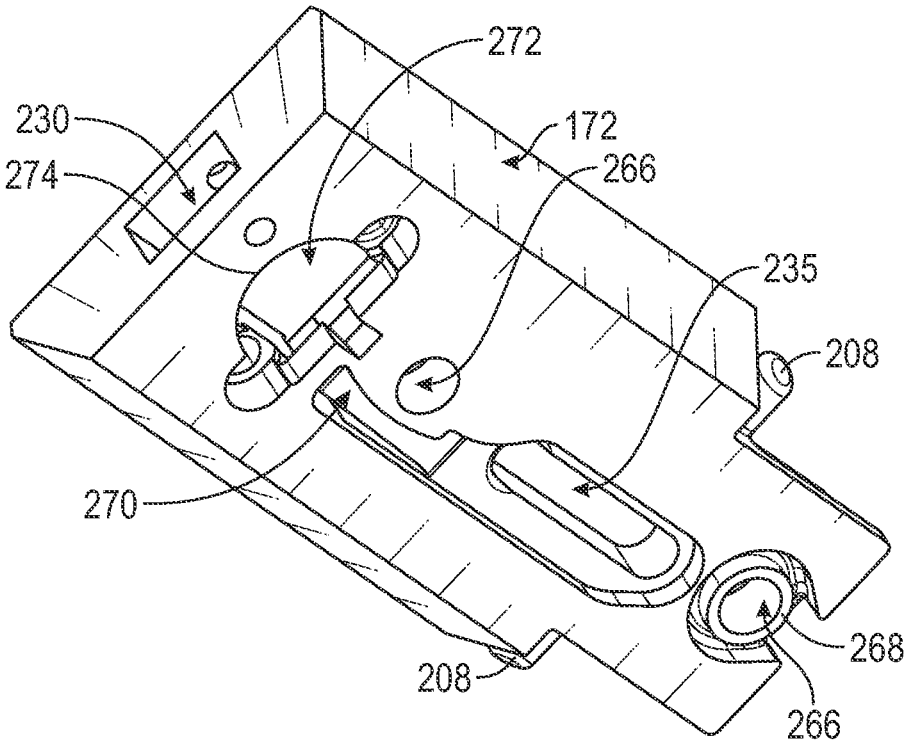

FIGS. 14A and 14B illustrate various views of the bolt 172. As shown, the bolt 172 can include openings 266. The screws 196 can extend through the openings 266 to couple the bolt 172 to the housing 114. As described herein, the bolt 172 can include an opening 272 through which the interference member 242 and springs 240 can extend. The opening 272 can be defined by a periphery which can include a surface 274. The head 243 of the interference member 242 can contact the surface 274 to advance the bolt 172 and ram 164 within the inner arm 130 a distance.

The bolt 172 can include a protrusion 268. The protrusion 268 can extend around the opening 266. The protrusion 268 can have a cylindrical shape. The cable 220 can wrap around the protrusion 268 to couple the carrier 170 to the bolt 172. The loop of the cable 220 can wrap around the protrusion 268.

The bolt 172 can include a slot 235. The rod 232 of the housing 114 can move within the slot 235. As described herein, the cable 134 can be coupled to the rod 232. The cable 134 can be routed from the rod 232, through a channel 270, and out of the bolt 172 by way of the opening 230. The opening 230 of the bolt 172 can receive the ram 164 (e.g., end portion of the tube 166) therein. The cable 134 can be routed through the opening 230 of the bolt 172, through an internal space of the tube 166 of the ram 164, out of the opening 192 in the head 168 of the ram 164, and couple to the claw 112.

Figure 15:
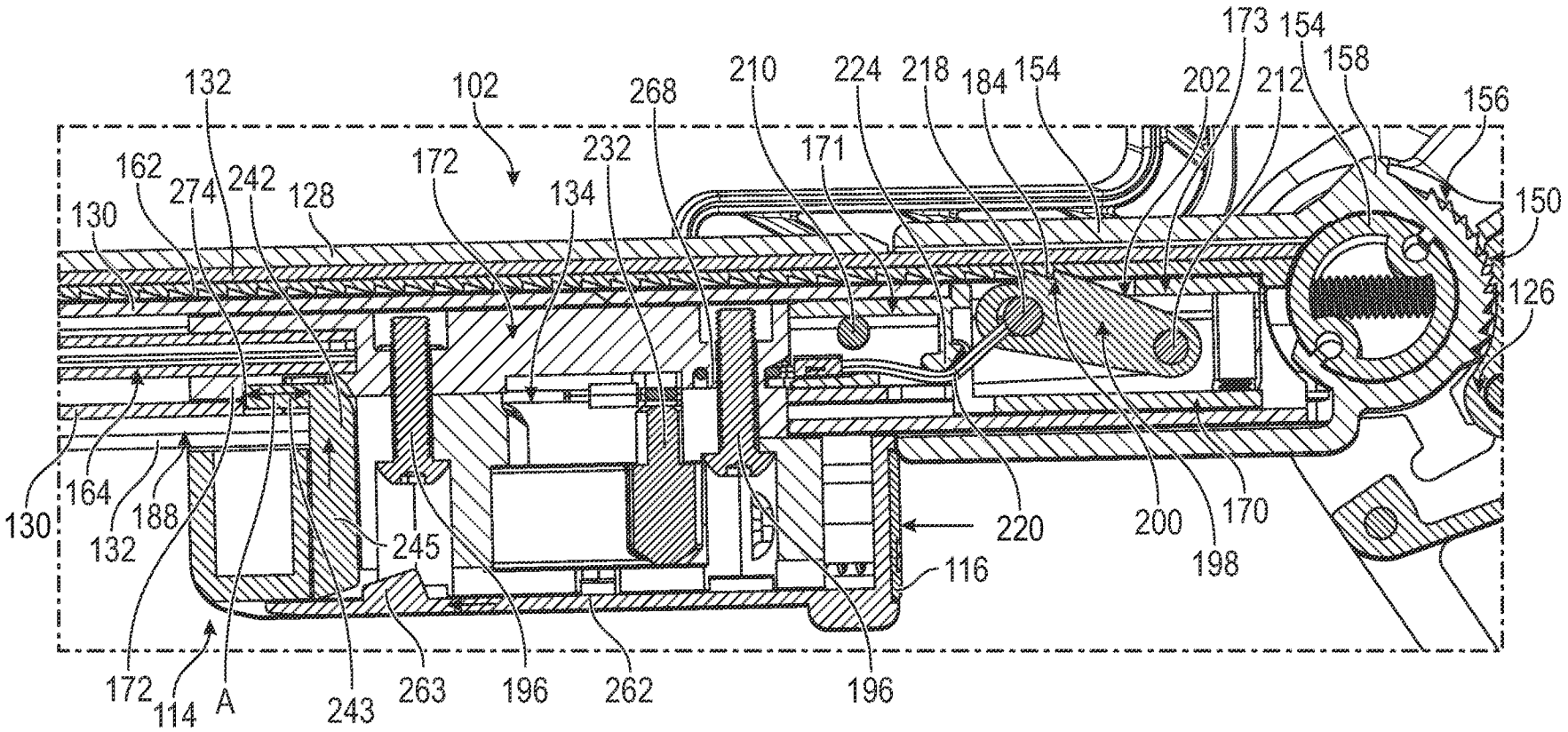
FIG. 15 illustrates a section view of a portion of the telescoping arm of the sport board rack.

FIG. 15 illustrates a cross-section of the first arm assembly 102. To open the claw 112 and/or extend the first arm assembly 102, the user can push on the button 116 of the housing 114, resulting in several response. The pushing of the button 116 can disengage the hook 244 of the button 116 and the hook 246 of the lever 118.

The pushing of the button 116 can advance the tongue 262 of the button 116 within a channel 260 of the housing 114. The tongue 262 can include a flange 263, which can include a curved and/or angled surface, that contacts a surface of the interference member 242. The interference member 242 can include a member 245 having a curved and/or angled surface, which can be at a bottom portion of the member 245. As the tongue 262 is advanced, the flange 263 can contact the member 245 (e.g., the curved and/or angled surface) of the interference member 242 to push the head 243 of the interference member 242 against the downward biasing force of the springs 240 and toward the bolt 172 to clear the head 243 of the periphery of the opening 174 of the inner arm 130. As described herein, the head 243 can contact the periphery of the opening 174 to couple the advancement of the inner arm 130 with the bolt 172. With the head 243 cleared of the periphery of the opening 174 of the inner arm 130, the pushing of the user can cause the head 243 to contact the surface 274 defining a portion of the periphery of the opening 272 of the bolt 172 to advance the bolt 172 within the inner arm 130 a distance A. The ram 164 can be rigidly coupled to the bolt 172 such that advancement of the bolt 172 within the inner arm 130 results in advancement of the ram 164 within the inner arm 130 by the distance A. The distance A can be the lateral distance from a leading edge of the head 243 to a leading edge of the member 245. The advancement of the ram 164 within the inner arm 130 can release the lock pin of the claw 112, allowing the claw 112 to be rotated open by a spring (e.g., torsion spring). The claw 112 can be coupled, by way of the cable 134, to the rod 232 such that the rotation open of the claw 112 can pull the rod 232 within the slot 234, causing the lever 118 to rotate out of the housing 114 with the hook 244 of the button 116 and the hook 246 of the lever 118 disengaged.

As the bolt 172 advances within the inner arm 130, the carrier 170 is stationary relative to the inner arm 130 because the rear portion 173 of the carrier 170 is disposed outside of the inner arm 130. However, despite advancement of the bolt 172 relative to the carrier 170, the bolt 172 and carrier 170 can remain coupled together by way of the springs 204 and cable 220. Accordingly, as the bolt 172 is advanced relative to the carrier 170, the cable 220 can be pulled by the advancement of the bolt 172. As described herein, the cable 220 can be routed around the guide 224 such that the pulling of the cable 220 resulting from the movement of the bolt 172 relative to the carrier 170 can cause the pawl 198 to be pulled down (e.g., rotated down), against the biasing force of the spring 228, to disengage the teeth 200 of the pawl 198 from the teeth 184 of the toothed insert 162. With the teeth 200 of the pawl 198 disengaged from the teeth 184 of the toothed insert 162, the pushing of the user can cause the inner arm 130, ram 164, bolt 172, housing 114, and/or carrier 170 to translate (e.g., advance) to extend the first arm assembly 102 (e.g., extend the inner arm 130 from within the outer arm 132, move the claw 112 away from the seat 108 and/or seat 110).

When the user ceases pushing, the springs 204 can pull the bolt 172 back toward the carrier 170 which can release the tension on the cable 220 such that the spring 228 rotates the pawl 198 to reengage the teeth 200 of the pawl 198 with the teeth 184 of the toothed insert 162 to lock the carrier 170 in a position, which can lock the inner arm 130 and/or claw 112 a distance away from the base 106, seat 108, and/or seat 110. When the user ceases pushing, the springs 204 can pull the bolt 172 back toward the carrier 170 such that the head 243 of the interference member 242 is repositioned, at least from the biasing force of the springs 240, to contact the portion of the periphery of the opening 174 of the inner arm 130, as shown in FIG. 15. This can lock the inner arm 130 and/or claw 112 in position to secure a board between the claw 112, seat 108, and/or seat 110. The pushing of the button 116 and/or housing 114 by the user can, as described herein, translate the inner arm 130 away from the seat 108 and/or seat 110 and/or rotate the claw 112 to free the board for removal and use.

The user can pull the housing 114 toward the base 106, seat 108, and/or seat 110 to retract the first arm assembly 102 (e.g., retract more of the inner arm 130 back into the outer arm 132) to move the claw 112 closer to the base 106, seat 108, and/or seat 110. The teeth 200 of the pawl 198 and the teeth 184 of the toothed insert 162 can be shaped to enable the teeth 200 of the pawl 198 to skip over the teeth 184 of the toothed insert 162 during retraction of the first arm assembly 102 but lock to prevent extension of the first arm assembly 102 without pushing the button 116, which can enable the claw 112 to securely hold a board between the claw 112 and the seat 108 and/or seat 110.

Figure 16A:
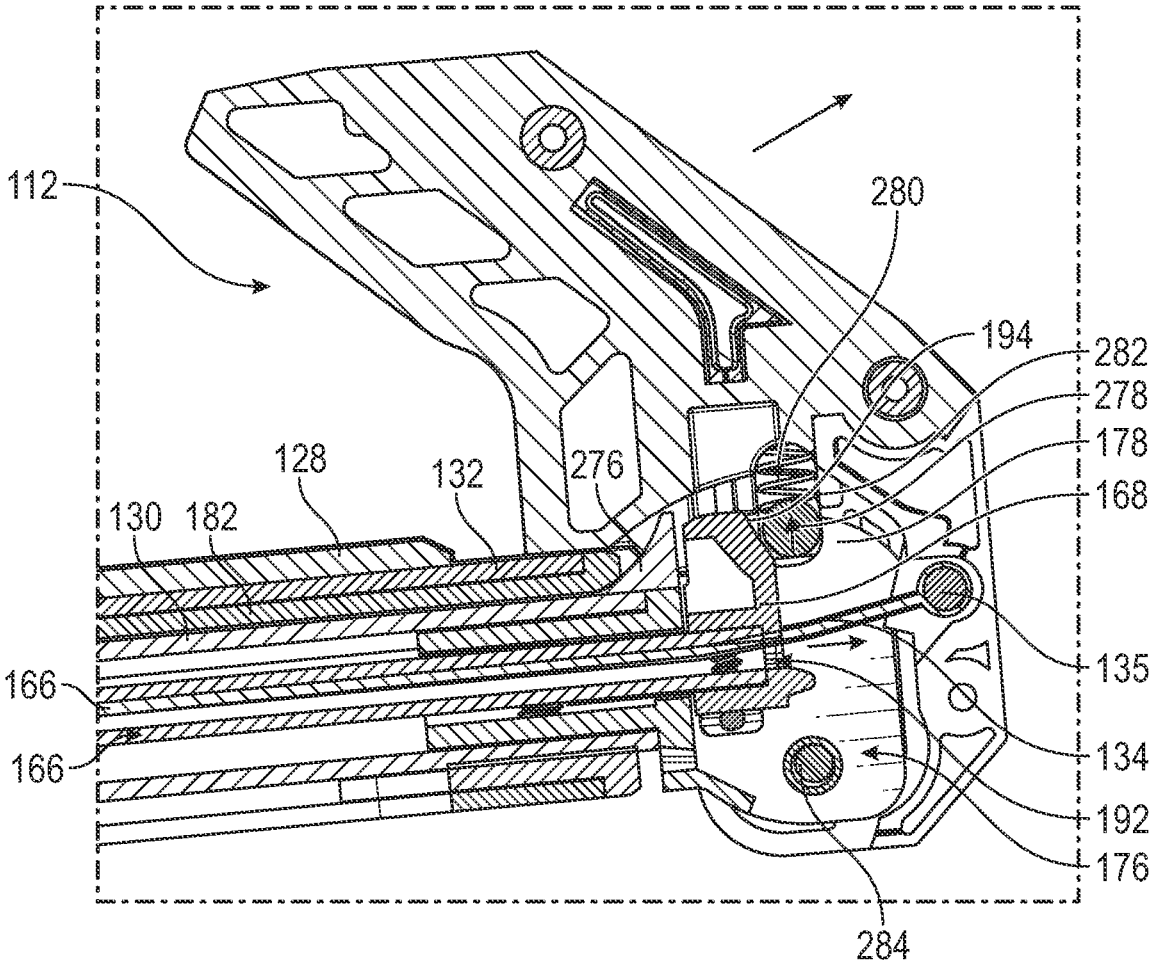
FIG. 16A illustrates a section view of the claw closed.
Figure 16B:
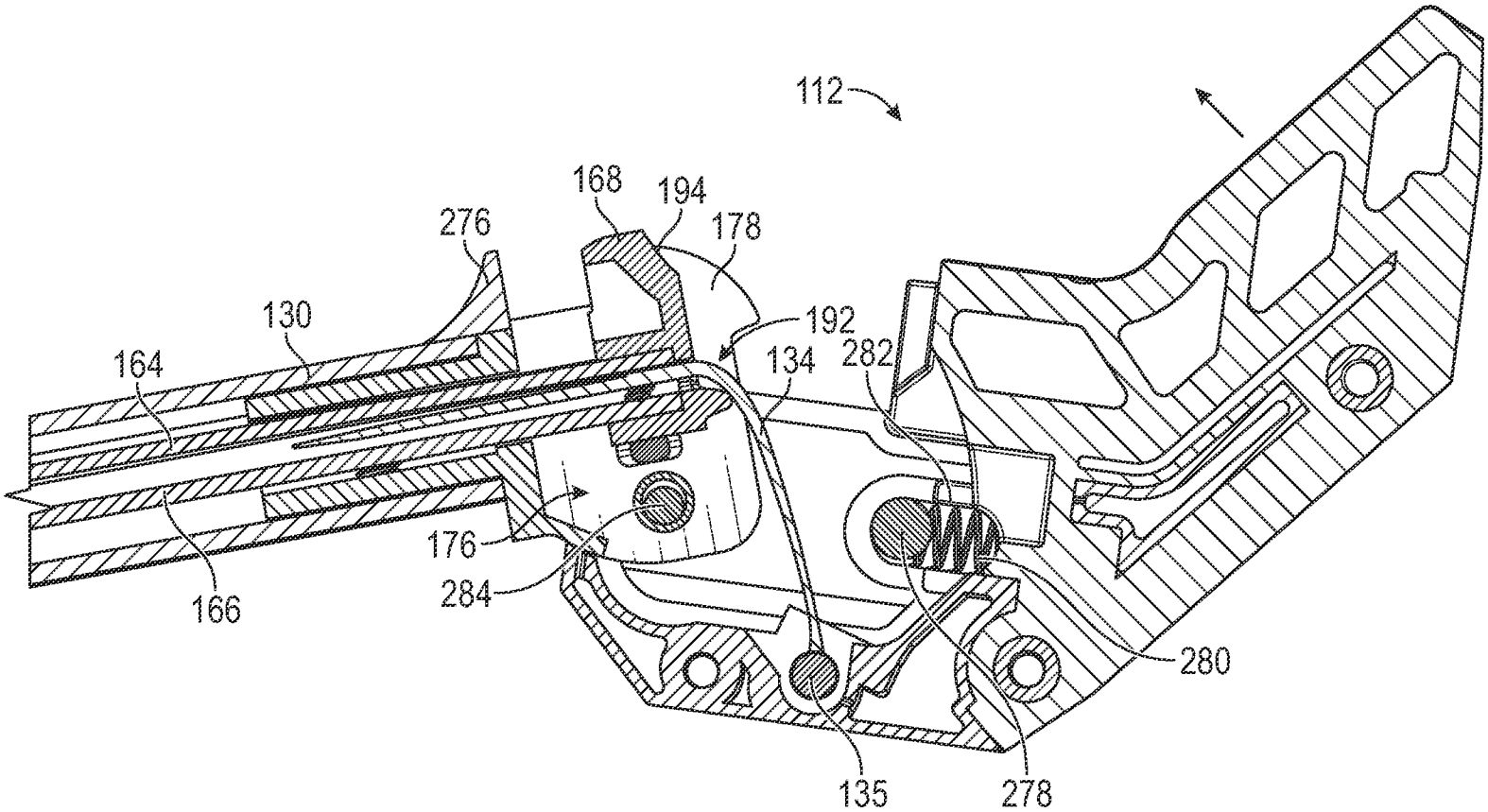
FIG. 16B illustrates a section view of the claw open.

FIG. 16A illustrates a section view of the claw 112 in the closed configuration. As shown, the claw 112 can include a lock pin 278 disposed in a slot 282 that can be biased by one or more lock springs 280 to secure the lock pin 278 under the flange(s) 178 (e.g., hooks, catches) of the base 176 fixedly mounted to the inner arm 130. The claw 112 can be rotatably coupled to the base 176 by a pivot pin 284. The claw 112 can include a spring, such as the spring 228 (e.g., torsion spring), that biases the claw 112 to the open position; however, the positioning of the lock pin 278 under the flanges 178 can prevent the spring from rotating the claw 112 open. The spring (e.g., torsion spring) can be disposed around the pivot pin 284 and bias the 112 to the open position. As described herein, the ram 164 can be advanced relative to the inner arm 130 so that a surface 194 (e.g., curved, angled surface) of the head 168 contacts and pushes the lock pin 278 within the slot 282, against the lock spring 280, and out from under the flanges 178, enabling the spring of the claw 112 to rotate the claw 112 to the open position, as illustrated in FIG. 16B.

As described herein, the cable 134 can be coupled to the claw 112. For example, an end portion 135, which can be cylindrical, can be coupled to the claw 112. As the claw 112 is rotated open by the spring, the cable 134 can be pulled, translating the rod 232 in the slot 234 and rotating the lever 118, disengaged from the hook 244, out of the housing 114. The lock pin 278 can be pushed to an end of the slot 282 by the one or more lock springs 280.

To close (e.g., rotate down) the claw 112, the lever 118 can be repositioned (e.g., rotated) back in the housing 114, translating the rod 232 and pulling the cable 134 to rotate (e.g., pull) the claw 112 back to the closed configuration illustrated in FIG. 16A. As the claw 112 is closing, the lock pin 278 can contact (e.g., ride) the periphery of the flanges 178 (e.g., curved periphery) to push against the biasing force of the one or more lock springs 280. As the lock pin 278 passes the flanges 178, the lock spring(s) 280 can position the lock pin 278 under the flanges 178 to lock the claw 112 in the closed configuration. A ramp 276, which can also be referred to as an angled and/or curved insert, can be disposed on an end portion of the inner arm 130. The ramp 276 can contact the mount 186 of the toothed insert 162 when the first arm assembly 102 is retracted.

As described herein, the first arm assembly 102 and second arm assembly 104 can be similar and/or the same.

Figure 17:
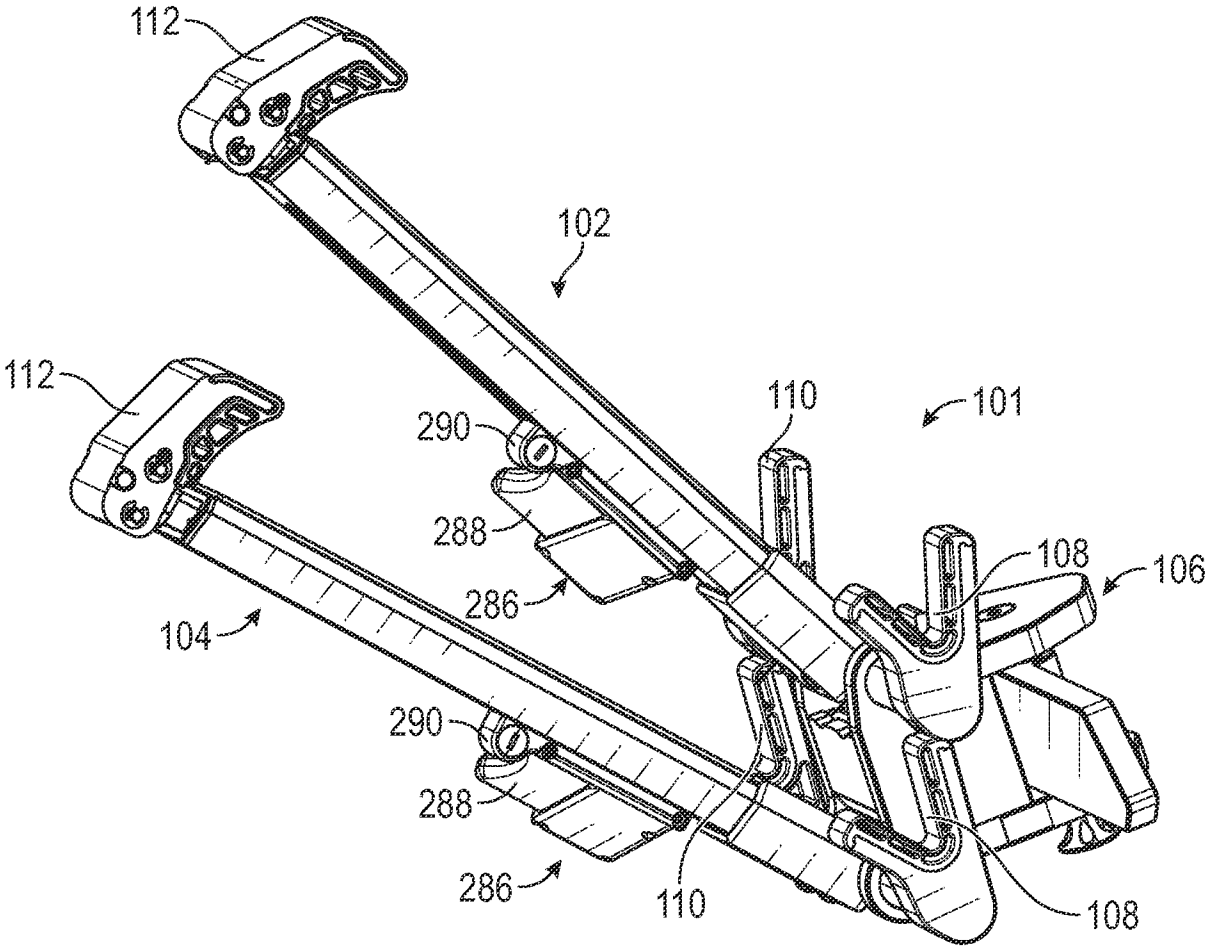
FIG. 17 illustrates another sport board rack.

FIG. 17 illustrates another board rack 101 which can at least include all of the features of the board rack 100 and/or the other board racks describe herein. The first arm assembly 102 and second arm assembly 104 can be the same or similar to each other.

The board rack 101 can include a housing 286, which can also be referred to as a slide, slider, and/or positioner, that can be incorporated with the first arm assembly 102 and/or second arm assembly 104. The housing 286 can be pushed away from the base 106, seat 108, and/or seat 110 to rotate the claw 112 to the open positon and/or extend the first arm assembly 102 to place a board on the seat 108 and/or seat 110. The housing 286 can include a trigger 288, which can also be referred to as a button. The trigger 288 can moved (e.g., squeezed, pulled, pushed) into the housing 286 to close the claw 112. The housing 286 can include a lock 290. The lock 290 can be locked or unlocked with a key and/or code to secure the first arm assembly 102 in a position to prevent a board secured between the claw 112, seat 108, and/or seat 110 from being removed without the key and/or code. For example, the lock 290 can lock the claw 112 in the closed position and the position of the inner arm 130.

Figure 18:
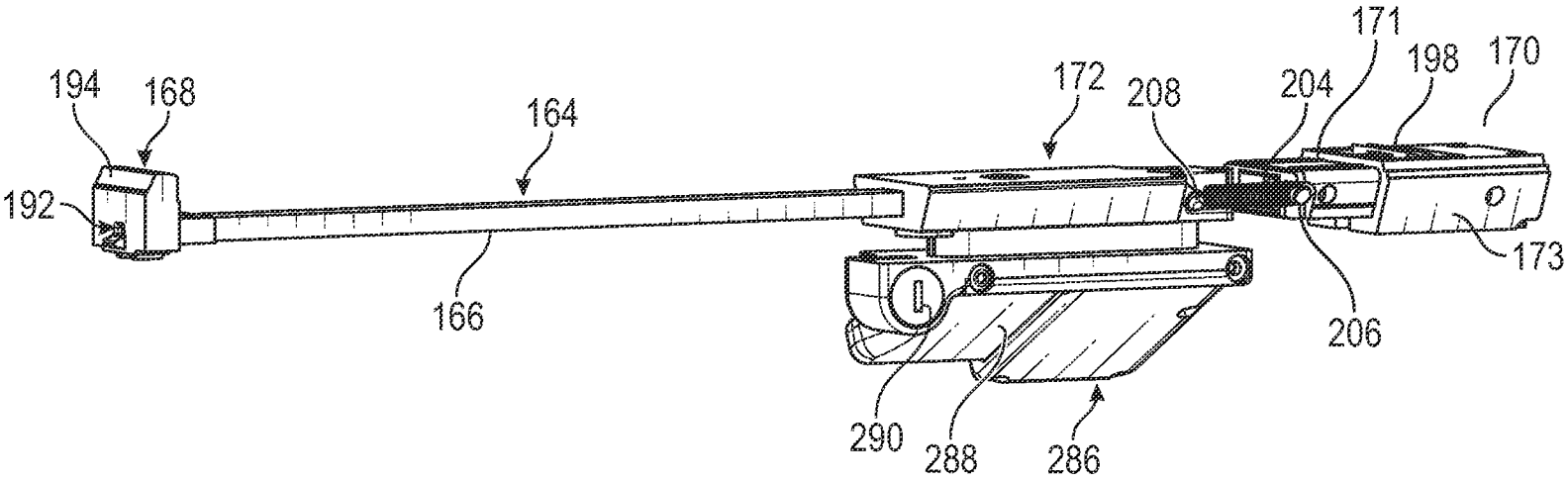
FIG. 18 illustrates at least some internal components of the telescoping arm of the sport board rack of FIG. 17.

FIG. 18 illustrates some of the internal components of the first arm assembly 102 of the board rack 101. The first arm assembly 102 of the board rack 101 can include a carrier 170, spring(s) 204, and/or ram 164 that are the same as or similar to those of the board rack 100. The carrier 170 can be coupled to a bolt 172 with one or more springs 204. The ram 164 can be fixedly coupled to the bolt 172. The housing 286 can be coupled to the bolt 172.

Figure 19:
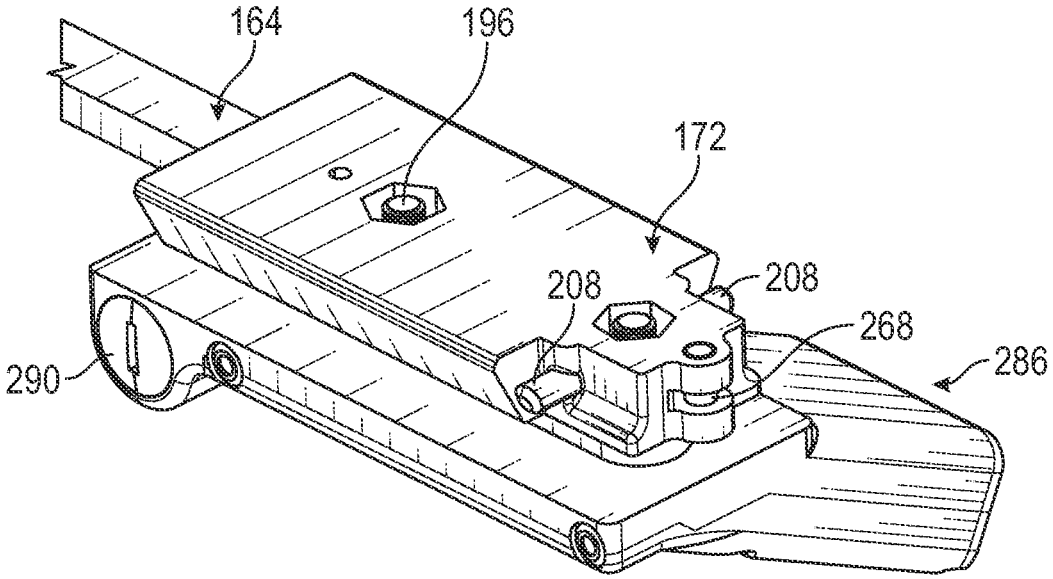
FIG. 19 illustrates the housing and bolt of the sport board rack of FIG. 17.

FIG. 19 illustrates the bolt 172. The bolt 172 can be similar to the bolt 172 disclosed in reference to board rack 100. The bolt 172 can be disposed in the inner arm 130. The bolt 172 can include an outer periphery corresponding to the inner periphery of the inner arm 130. The bolt 172 can be secured to the housing 286 with screws 196. The bolt 172 can include a protrusion 268, which can also be referred to as a pin, rod, and/or shaft, disposed at an end portion of the bolt 172. The cable 220 can be coupled to the protrusion 268 to couple the bolt 172 and carrier 170 together, as described herein.

Figure 20:
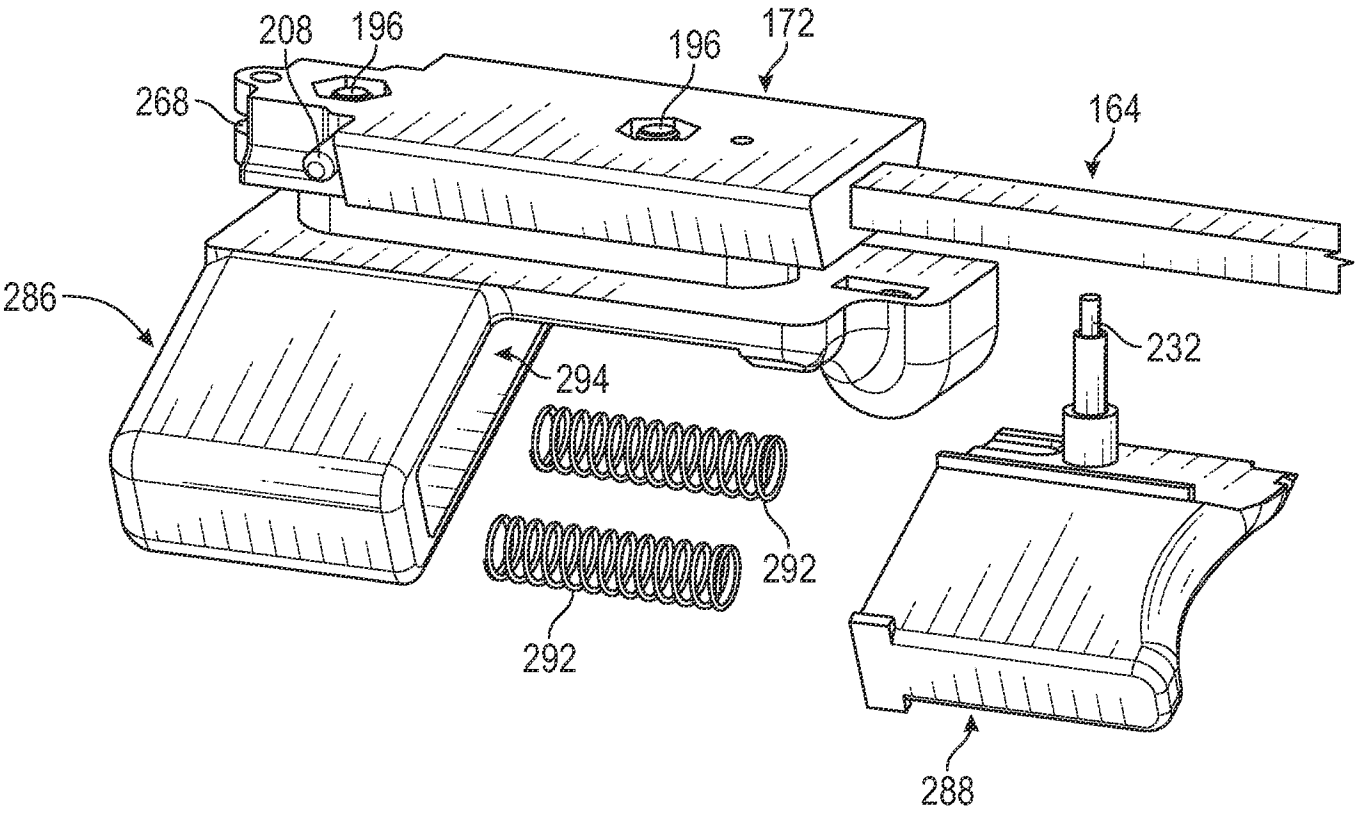
FIG. 20 illustrates a partially exploded view of the housing of the sport board rack of FIG. 17.
Figure 21A:
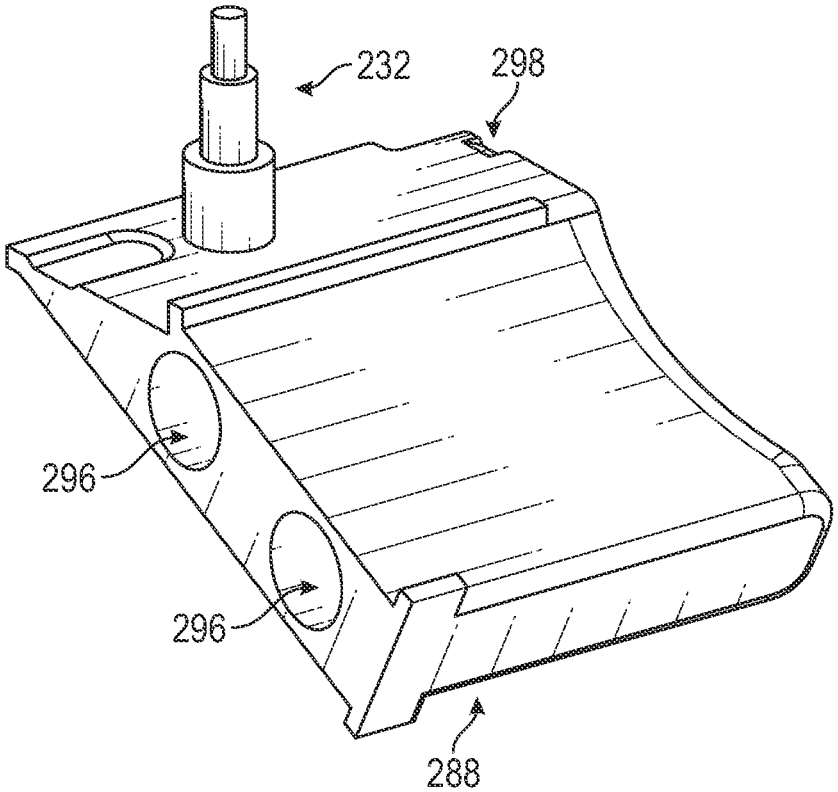
FIGS. 21A and 21B illustrate a trigger of the housing of the sport board rack of FIG. 17.
Figure 21B:
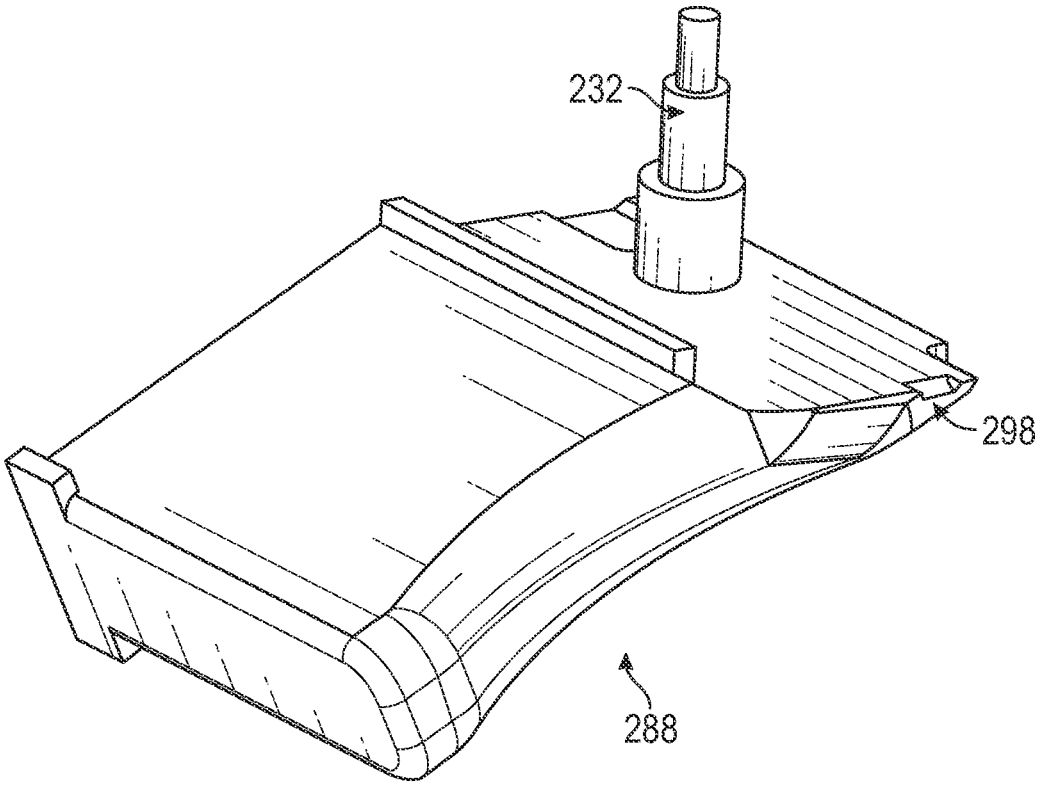

FIG. 20 illustrates a partially exploded view of the housing 286. The housing 286 can include an interior 294 that can house the trigger 288 therein. The trigger 288 can be biased outward by one or more springs 292, which can be helical springs, such that the user squeezes the trigger 288 to close the claw by overcoming the biasing force of the one or more springs 292. As shown in FIGS. 21A and 21B, the trigger 288 can include slot(s) 296 that can receive the one or more springs 292. The trigger 288 can include a rod 232 (e.g., pin, bar) that can be coupled with the cable 134 coupled to the claw 112. When the claw 112 is rotated open, the trigger 288 can be squeezed to translate the rod 232 and pull the cable 134 to rotate the claw 112 closed. The claw 112 can be locked in the closed position by way of a lock pin 278 as described in reference to board rack 100.

The trigger 288 can include a ramp 298, which can also be referred to as an angled and/or curved surface. The ramp 298 can be pressed against the interference member 242 (e.g., member 245 of the interference member 242) to push (e.g., clear) the head 243 of the interference member 242 from a portion of the periphery of the opening 174 of the inner arm 130 and translate the bolt 172 and ram 164 relative to the inner arm 130 and carrier 170, as described herein.

Figure 22:
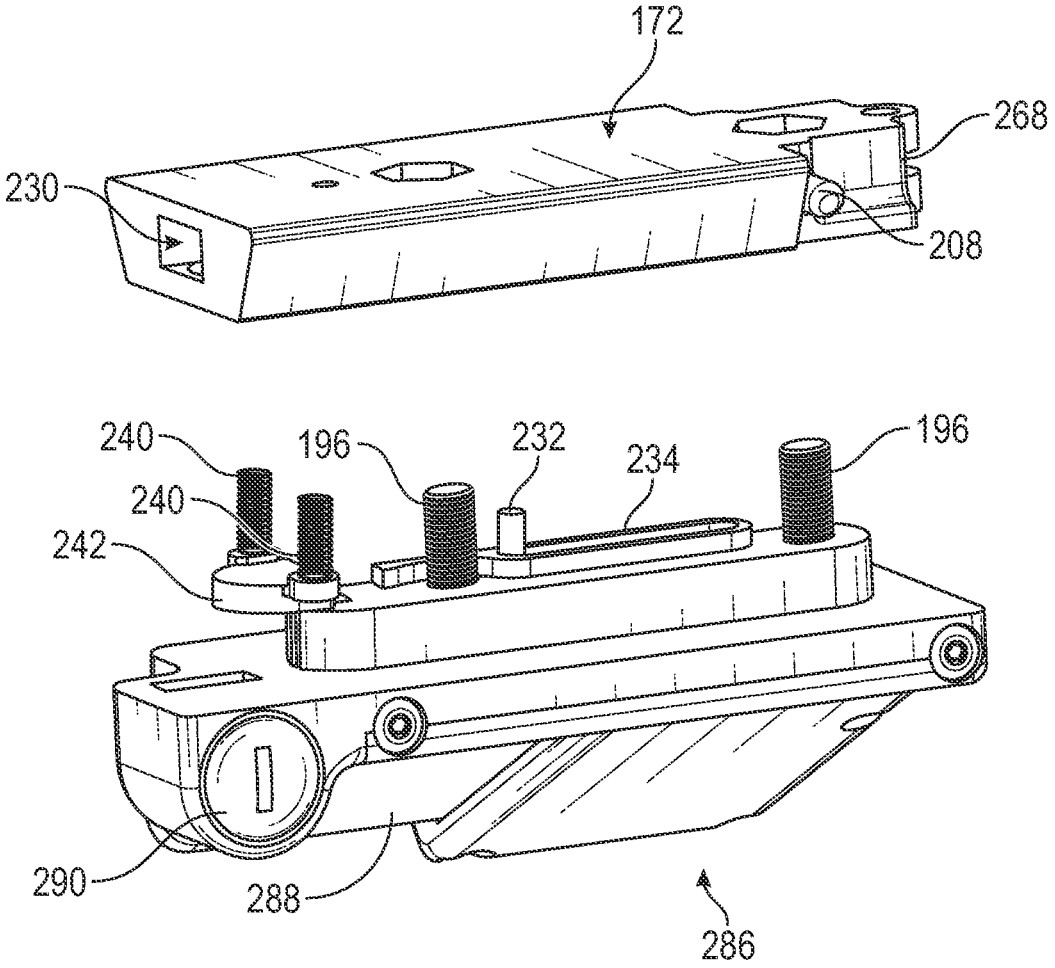
FIG. 22. illustrates a partially exploded view of the housing and the bolt of the sport board rack of FIG. 17.

FIG. 22 illustrates a partially exploded view of the bolt 172 and housing 286. Similar to the board rack 100, the bolt 172 can include an interference member 242 that can be biased downward by one or more springs 240. The bolt 172 can include a protrusion 236 that can extend through the opening 174 of the inner arm 130 and the opening 188 of the outer arm 132 to facilitate the coupling of the bolt 172 with the housing 286. The housing 286 can include a slot 234. The rod 232 can move within the slot 234 as the trigger 288 is squeezed and released.

Figure 23:
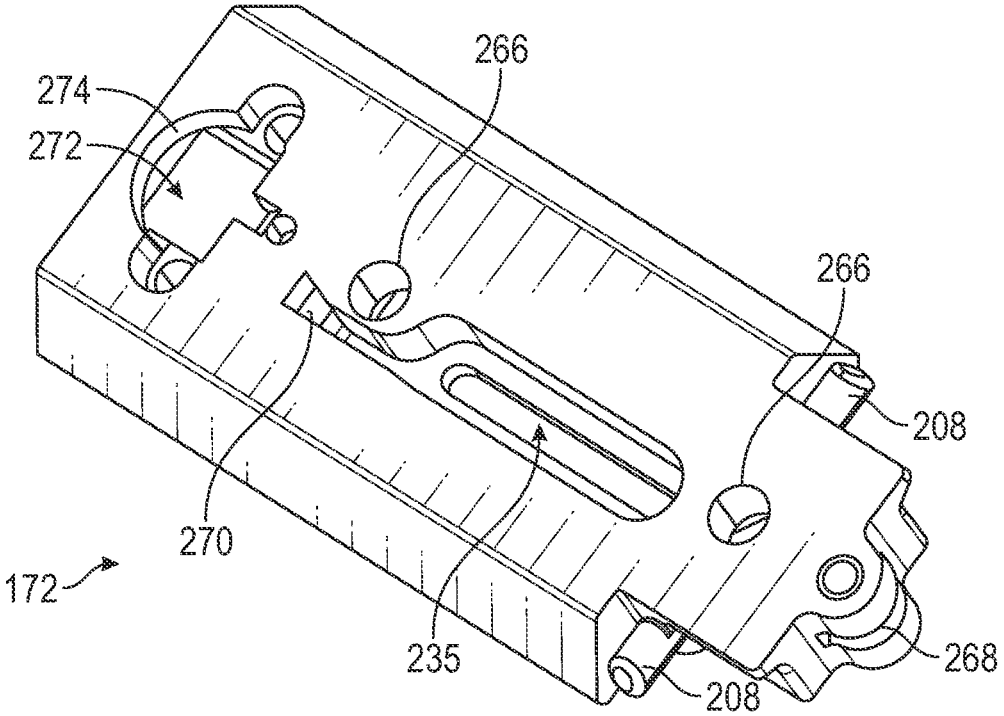
FIG. 23 illustrates the bolt of the sport board rack of FIG. 17.
Figure 24:
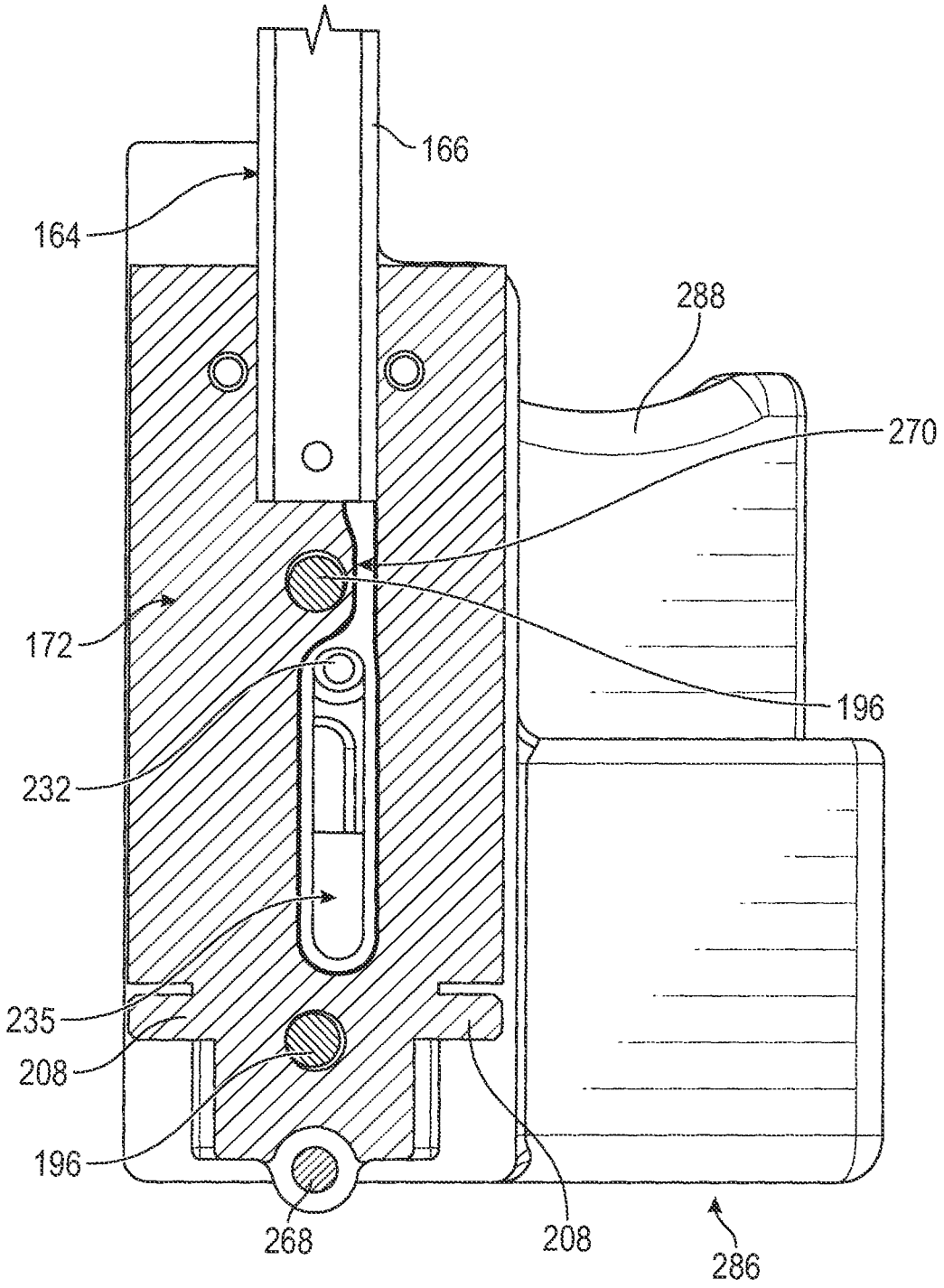
FIG. 24 illustrates a section view of the bolt coupled to the housing of the sport board rack of FIG. 17.

FIGS. 23 and 24 illustrate views of the bolt 172. The bolt 172 can include an opening 272 through which the interference member 242 and/or spring(s) 240 can extend. A surface 274 defining a periphery of the opening 272 can contact the head 243 of the interference member 242 to translate the ram 164 and bolt 172 relative to the inner arm 130 and carrier 170.

The bolt 172 can include openings 266 through which the screws 196 can be placed to couple the bolt 172 to the housing 286. The bolt 172 can include a slot 235 in which the rod 232 can translate. The bolt 172 can include a channel 270 through which the cable 134 can be routed to exit the bolt 172 and extend through the ram 164 to couple to the claw 112, as described herein.

Figure 25A:
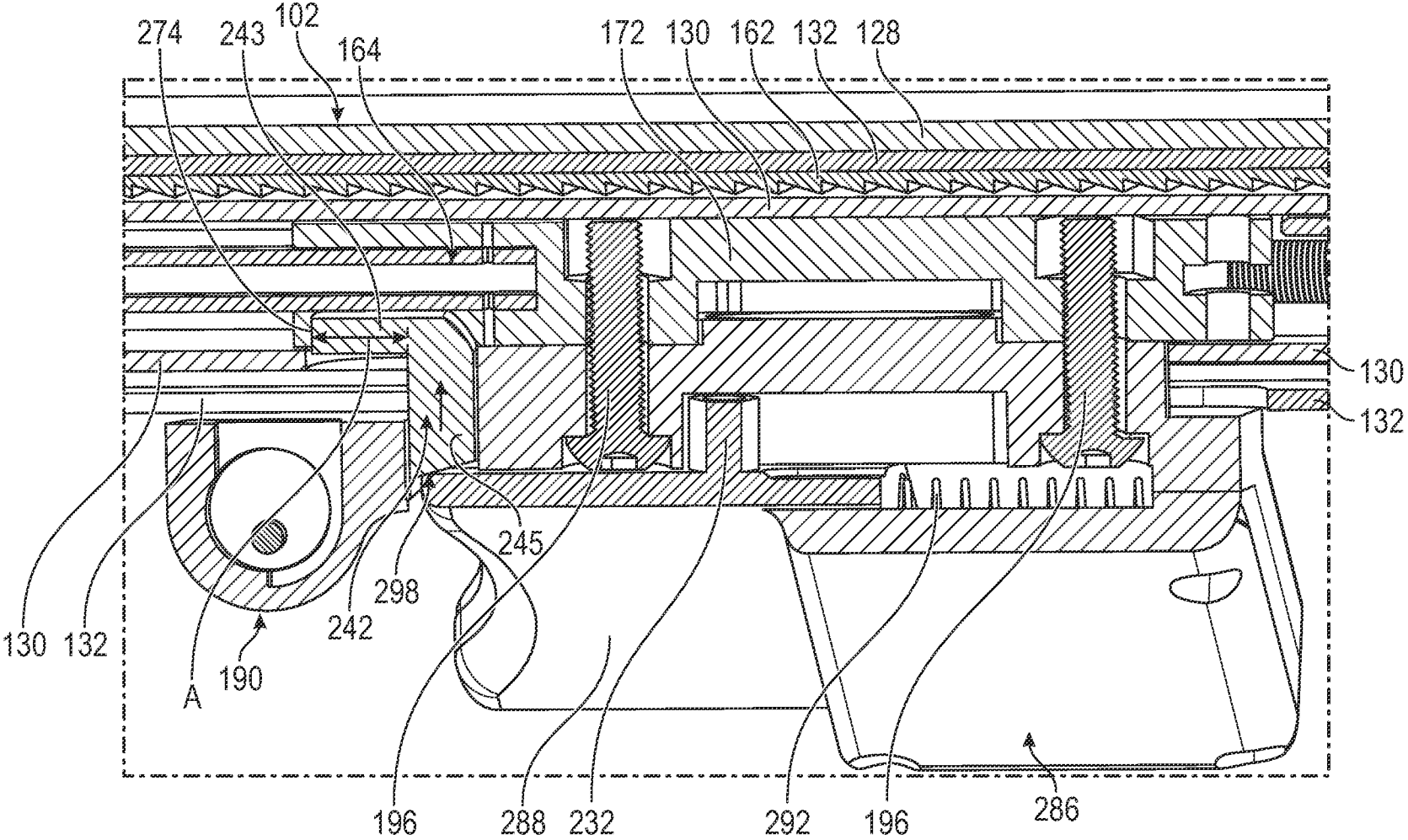
FIG. 25A illustrates a section view of a portion of the telescoping arm of the sport board rack of the sport board rack of FIG. 17 with the claw closed.
Figure 25B:
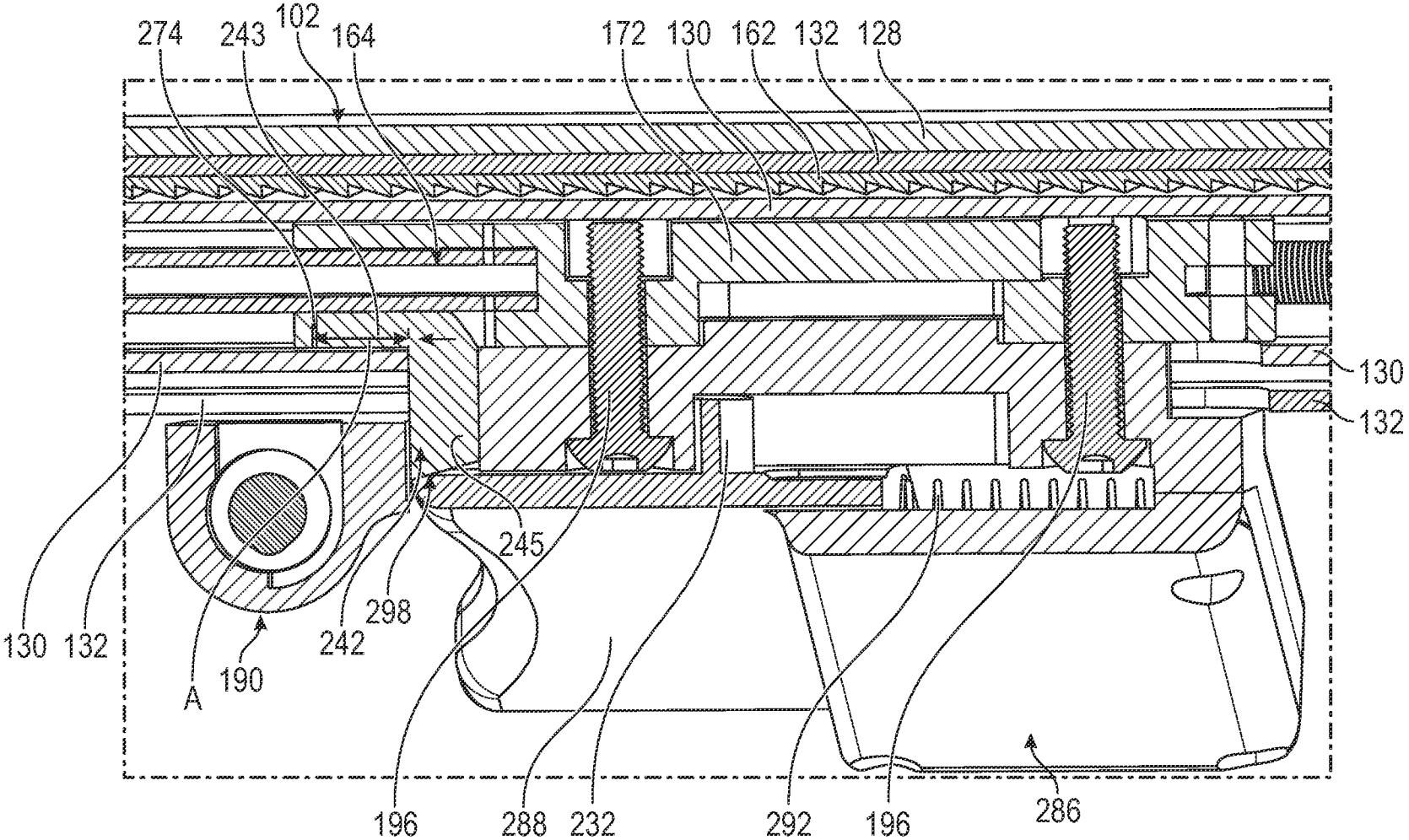
FIG. 25B illustrates a section view of a portion of the telescoping arm of the sport board rack of the sport board rack of FIG. 17 with the claw open.

FIG. 25A illustrates a section view of the first arm assembly 102 with the claw 112 in the closed configuration. To extend the first arm assembly 102 and open the claw 112, the user can translate (e.g., push) the housing 286 in a direction away from the base 106, seat 108, and/or seat 110. As the housing 286 is pushed, the ramp 298 of the trigger 288 can contact the interference member 242 (e.g., curved and/or angled surface of the member 245) to push the head 243 of the interference member 242 against the downward biasing force of the springs 240 and toward the bolt 172 to clear the head 243 of the periphery of the opening 174 of the inner arm 130. As described herein, the head 243 can contact the periphery of the opening 174 to couple the advancement of the inner arm 130 with the bolt 172. With the head 243 cleared of the periphery of the opening 174 of the inner arm 130, the pushing of the user can cause the head 243 to contact the surface 274 defining a portion of the periphery of the opening 272 of the bolt 172 to advance the bolt 172 within the inner arm 130 a distance A, as shown in FIG. 25B which illustrates a section view of the first arm assembly 102 with the claw 112 in the open configuration.

The ram 164 can be rigidly coupled to the bolt 172 such that advancement of the bolt 172 within the inner arm 130 can result in advancement of the ram 164 within the inner arm 130 by the distance A. The distance A can be the lateral distance from a leading edge of the head 243 to a leading edge of the member 245. The advancement of the ram 164 within the inner arm 130 can release the lock pin of the claw 112, allowing the claw 112 to be rotated open by a spring (e.g., torsion spring) as described herein. The claw 112 can be coupled, by way of the cable 134, to the rod 232. Accordingly, the user can close (e.g., rotate closed) the claw 112 by squeezing the trigger 288, which can pull the cable 134 to rotate the claw 112 to the closed position and lock the claw 112 with the lock pin 278.

As the bolt 172 advances within the inner arm 130, the carrier 170 can be stationary relative to the inner arm 130 because the rear portion 173 of the carrier 170 can be disposed outside of the inner arm 130. However, despite advancement of the bolt 172 relative to the carrier 170, the bolt 172 and carrier 170 can remain coupled together by way of the springs 204 and cable 220. Accordingly, as the bolt 172 is advanced relative to the carrier 170, the cable 220 can be pulled by the movement of the bolt 172. As described herein, the cable 220 can be routed around the guide 224 such that the pulling of the cable 220 resulting from the movement of the bolt 172 relative to the carrier 170 can cause the pawl 198 to be pulled down (e.g., rotated down), against the biasing force of the spring 228, to disengage the teeth 200 of the pawl 198 from the teeth 184 of the toothed insert 162. With the teeth 200 of the pawl 198 disengaged from the teeth 184 of the toothed insert 162, the pushing of the user can cause the inner arm 130, ram 164, bolt 172, housing 286, and/or carrier 170 to translate (e.g., advance) to extend the first arm assembly 102 (e.g., extend the inner arm 130 from within the outer arm 132, move the claw 112 away from the seat 108 and/or seat 110).

When the user ceases pushing the housing 286, the springs 204 can pull the bolt 172 back toward the carrier 170 which can release the tension on the cable 220 such that the spring 228 rotates the pawl 198 to reengage the teeth 200 of the pawl 198 with the teeth 184 of the toothed insert 162 to lock the carrier 170 in a position, which can lock the inner arm 130 and/or claw 112 a distance away from the base 106, seat 108, and/or seat 110. When the user ceases pushing the housing 286, the springs 204 can pull the bolt 172 back toward the carrier 170 such that the head 243 of the interference member 242 is repositioned to contact the portion of the periphery of the opening 174 of the inner arm 130, as shown in FIG. 25A. The user can pull the housing 286 to retract the first arm assembly 102 (e.g., retract more of the inner arm 130 back into the outer arm 132) to move the claw 112 closer to the base 106, seat 108, and/or seat 110. The teeth 200 of the pawl 198 and the teeth 184 of the toothed insert 162 can be shaped to enable the teeth 200 of the pawl 198 to skip over the teeth 184 of the toothed insert 162 during retraction of the first arm assembly 102 but lock to prevent extension of the first arm assembly 102 without pushing the button 116, which can enable the claw 112 to securely hold a board between the claw 112 and the seat 108 and/or seat 110.

Figure 26:
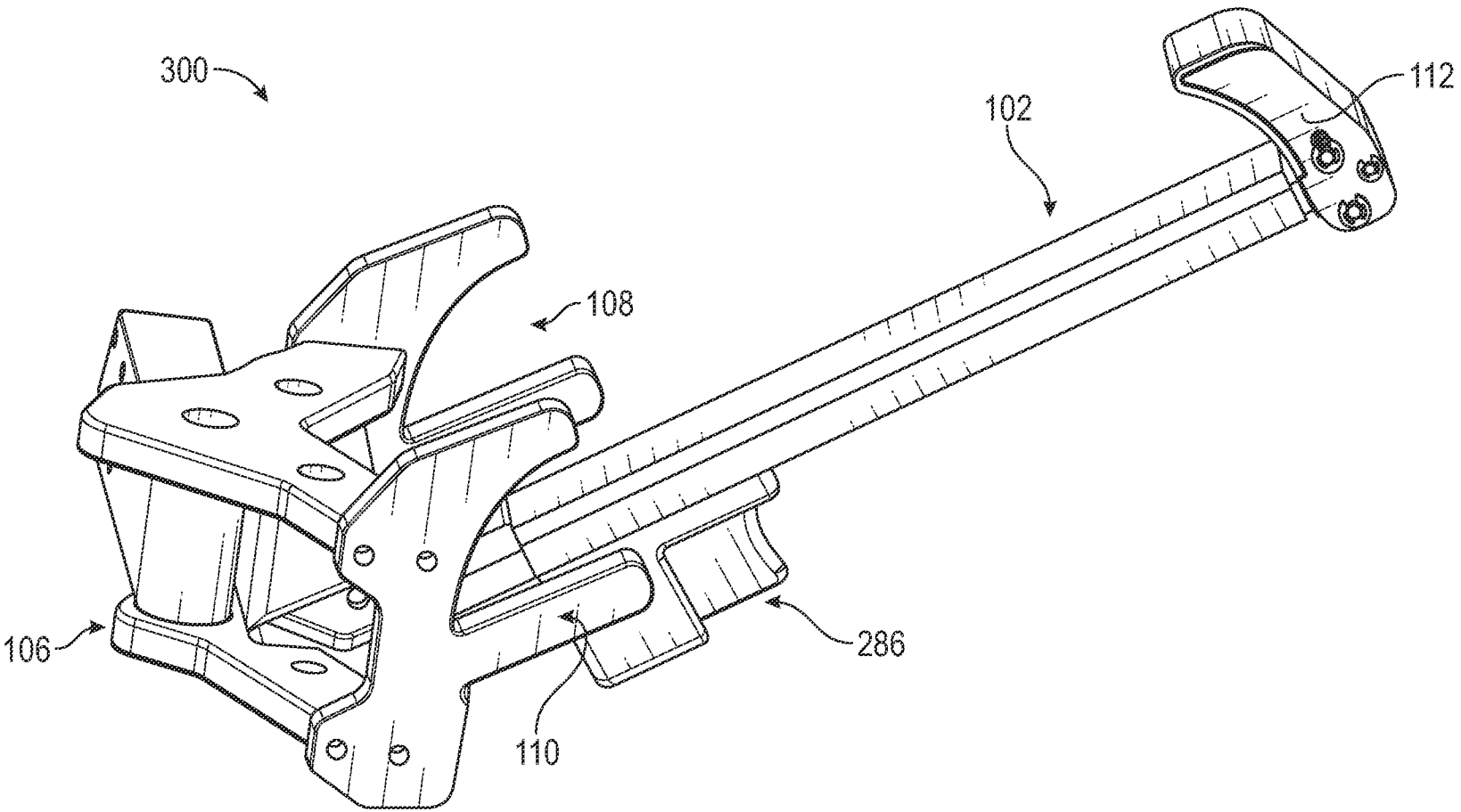
FIG. 26 illustrates another sport board rack.

FIG. 26 illustrates another board rack 300. The board rack 300 can at least include all of the features of the other board racks described herein. The board rack 300 can include a first arm assembly 102. Instead of pivoting, the first arm assembly 102 can be unable to pivot to different positions. In some variants, the first arm assembly 102 may be able to pivot with respect to the base 106. In some variants, the board rack 300 may be modular, allowing for multiple of the board rack 300 to be coupled together. In some variants, the first arm assembly 102 can be operated (e.g., extended and/or retracted) with one or more gas rams. In some variants, the claw 112 can be operated (e.g., closed and/or opened) with one or more gas rams.

Figure 27:
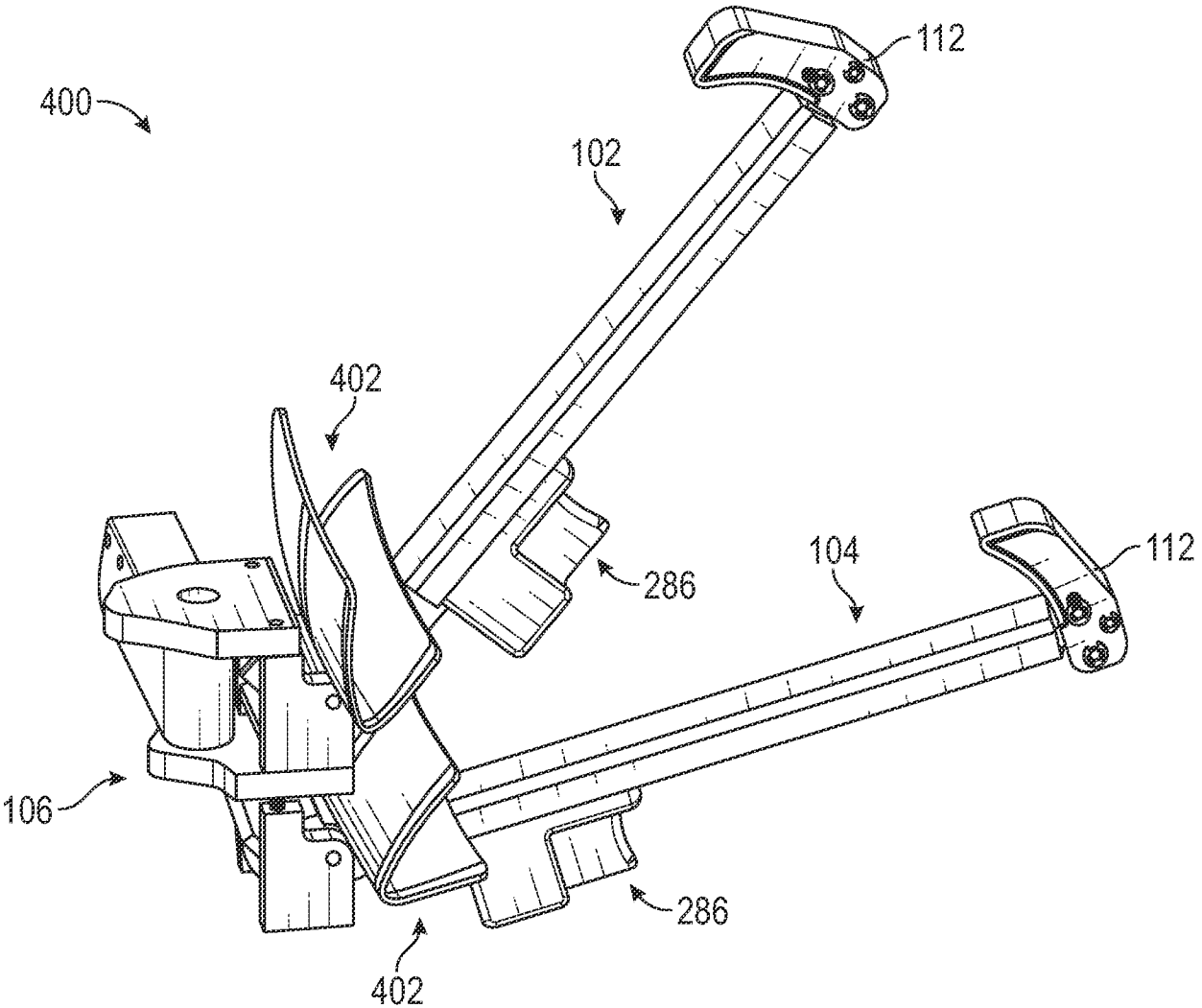
FIG. 27 illustrates another sport board rack.

FIG. 27 illustrates another board rack 400. The board rack 400 can at least include all of the features of the other board racks described herein. The board rack 400 may include a first arm assembly 102 and/or second arm assembly 104, which can pivot with respect to each other. Instead of including a seat 108 and/or seat 110, the board rack 400 may include a single seat 402 for the first arm assembly 102 and/or second arm assembly 104. The seat 402 can include an elongate fork structure. The seat 402 can include a longitudinal length of 6, 7, 8, 9, 10, 11, 12, 13, 14, 15, 16, 17, 18, 19, 20, 21, 22, 23, 24, 25, 26, 27, 28, 29, 30, or more inches. A board can be secured between the seat 402 and the claw 112.

Figure 28A:
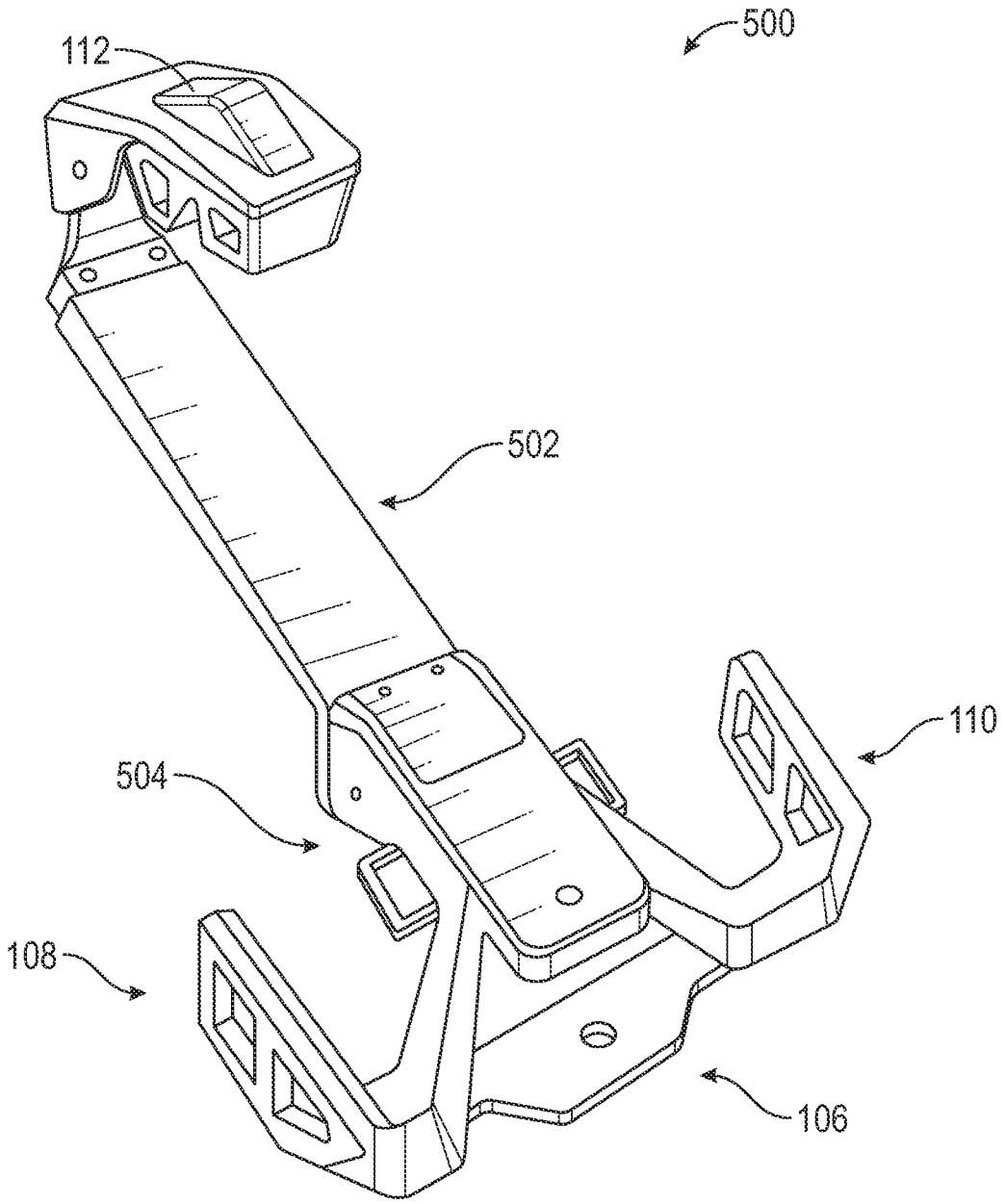
FIG. 28A illustrates another sport board rack.
Figure 28B:
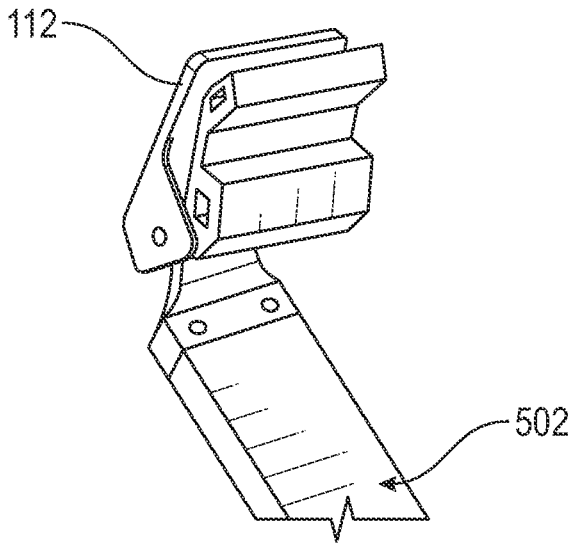
FIG. 28B illustrates the sport board rack of FIG. 28A with the claw open.
Figure 28C:
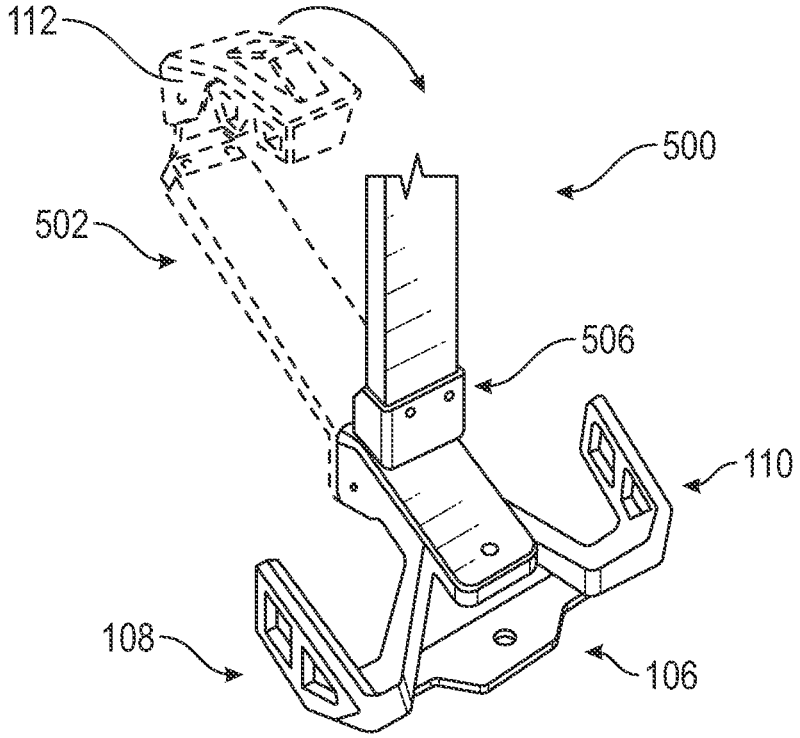
FIG. 28C illustrates the sport board rack of FIG. 28A with the arm pivoted.

FIGS. 28A-28C illustrate another board rack 500. The board rack 500 can at least include all of the features of the other board racks described herein. The board rack 500 can include an arm 502. The arm 502 may not telescope. In some variants, the arm 502 may telescope. The arm 502 can include a claw 112 that may pivot between a closed position, as shown in FIG. 28A, and an open position, as shown in FIG. 28B. The claw 112 can include a cam system that can be operated by way of manipulation of a lever 504 to facilitate rotating between and/or locking at the open and closed positions. As shown in FIG. 28C, the arm 502 can be pivoted about a joint 506. The board rack 500 can be modular to allow multiple board racks 500 to be stacked on top of each other (e.g., the bases 106 can be stacked and coupled together).

Although this disclosure has been described in the context of certain embodiments and examples, a person of ordinary skill in the art would recognize, after reviewing the disclosure herein, that any embodiment disclosed can be combined with other embodiments, portions/aspects of other embodiments, and/or technologies known in the art to accomplish the desired advantages discussed herein. It will be understood by those skilled in the art, after reviewing the disclosure herein, that the disclosure extends beyond the specifically disclosed embodiments to other alternative embodiments and/or uses and obvious modifications and equivalents thereof. In addition, while several variations of the embodiments of the disclosure have been shown and described in detail, other modifications, which are within the scope of this disclosure, will be readily apparent to those of skill in the art after reviewing the disclosure herein. It is also contemplated that various combinations or sub-combinations of the specific features and aspects of the embodiments may be made and still fall within the scope of the disclosure. For example, features described above in connection with one embodiment can be used with a different embodiment described herein and the combination still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above. Accordingly, unless otherwise stated, or unless clearly incompatible, each embodiment of this invention may comprise, additional to its essential features described herein, one or more features as described herein from each other embodiment of the invention disclosed herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate after reviewing the disclosure herein that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize, after reviewing the disclosure herein, that the disclosure may be embodied or carried out in a manner that achieves one advantage or a group of advantages as taught herein without necessarily achieving other advantages as may be taught or suggested herein.

Conditional language used herein, such as, among others, "can," "could," "might." "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without other input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The term "and/or" has similar meaning in that when used, for example, in a list of elements, the term "and/or" means one, some, or all of the elements in the list, but does not require any individual embodiment to have all elements.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

Values and ranges of values disclosed herein are examples and should not be construed as limiting. The values and ranges of values disclosed herein can be altered while gaining the advantages discussed herein. The listed ranges of values disclosed herein can include subsets of ranges or values which are part of this disclosure. Disclosed ranges of values or a single value for one feature can be implemented in combination with any other compatible disclosed range of values or value for another feature. For example, any specific value within a range of dimensions for one element can be paired with any specific value within a range of dimensions for another element. One of ordinary skill in the art will recognize from the disclosure herein that any disclosed length of a spar may be combined with any disclosed width of a foil, each having any disclosed shape.

Any methods disclosed herein need not be performed in the order recited. The methods disclosed herein include certain actions taken by a practitioner; however, they can also include any third-party instruction of those actions, either expressly or by implication. For example, actions such as "controlling a motor speed" include "instructing controlling of a motor speed."

All of the methods and tasks described herein may be performed and fully automated by a computer system. The computer system may, in some cases, include multiple distinct computers or computing devices (e.g., physical servers, workstations, storage arrays, cloud computing resources, etc.) that communicate and interoperate over a network to perform the described functions. Each such computing device typically includes a processor (or multiple processors) that executes program instructions or modules stored in a memory or other non-transitory computer-readable storage medium or device (e.g., solid state storage devices, disk drives, etc.). The various functions disclosed herein may be embodied in such program instructions, and/or may be implemented in application-specific circuitry (e.g., ASICs or FPGAs) of the computer system. Where the computer system includes multiple computing devices, these devices may, but need not, be co-located. The results of the disclosed methods and tasks may be persistently stored by transforming physical storage devices, such as solid state memory chips and/or magnetic disks, into a different state. In some embodiments, the computer system may be a cloud-based computing system whose processing resources are shared by multiple distinct business entities or other users.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Additionally, all publications, patents, and patent applications mentioned in this specification are herein incorporated by reference to the same extent as if each individual publication, patent, or patent application was specifically and individually indicated to be incorporated by reference.

What is claimed is:

1. A board rack configured to be incorporated onto a power boat, the board rack comprising:

a base;

a first pair of seats configured to receive a first board;

a second pair of seats configured to receive a second board;

a first telescoping arm configured to move between an extended position and a retracted position, the first telescoping arm comprising a first claw configured to cooperate with the first pair of seats to secure the first board between the first claw and the first pair of seats; and a second telescoping arm configured to move between an extended position and a retracted position, the second telescoping arm comprising a second claw configured to cooperate with the second pair of seats to secure the second board between the second claw and the second pair of seats;

wherein the first telescoping arm and the first pair of seats are configured to pivot together with respect to the base; and wherein the second telescoping arm and the second pair of seats are configured to pivot together with respect to the base and separately from the first telescoping arm and the first pair of seats.

2. The board rack of claim 1, wherein the first claw and the second claw are configured to rotate between an open configuration to facilitate placing the first board and the second board on the first pair of seats and the second pair of seats, respectively, and a closed configuration to facilitate securing the first board between the first claw and the first pair of seats and the second board between the second claw and the second pair of seats.

3. The board rack of claim 2, wherein each of the first telescoping arm and the second telescoping arm comprises a lever configured to be manipulated to rotate the first claw and the second claw between the open configuration and the closed configuration.

4. The board rack of claim 1, wherein each of the first telescoping arm and the second telescoping arm comprises a release configured to be manipulated to enable the first telescoping arm and the second telescoping arm to be pushed to the extended position.

5. The board rack of claim 1, wherein each of the first telescoping arm and the second telescoping arm comprises an inner arm and an outer arm, the inner arm configured to be moved within the outer arm to move between the extended position and the retracted position.

6. The board rack of claim 1, wherein each of the first telescoping arm and the second telescoping arm comprises a pawl and a ratchet insert, the pawl biased by way of a spring to engage with teeth of the ratchet insert to prevent moving of the first telescoping arm and the second telescoping arm to the extended position without manipulating a release.

7. The board rack of claim 1, further comprising a first shaft and a second shaft, the first telescoping arm and the first pair of seats coupled to the first shaft, and the second telescoping arm and the second pair of seats coupled to the second shaft.

8. The board rack of claim 7, wherein longitudinal lengths of the first telescoping arm and the first shaft are perpendicularly orientated relative to each other, and wherein longitudinal lengths of the second telescoping arm and the second shaft are perpendicularly orientated relative to each other.

9. The board rack of claim 7, further comprising a first lever and a second lever, the first lever configured to engage the first shaft to lock the first shaft in a position of rotation, and the second lever configured to engage the second shaft to lock the second shaft in a position of rotation.

10. The board rack of claim 9, wherein the first lever and the second lever are configured to be manipulated to release the first shaft and the second shaft for rotation.

11. A board rack configured to be incorporated onto a power boat, the board rack comprising:

a base configured to be incorporated with a tower of the power boat;

a first seat and a second seat, the first seat and the second seat configured to receive a board; and a telescoping arm configured to move between an extended position and a retracted position, the telescoping arm comprising a claw, a pawl, and a ratchet insert, the claw configured to rotate between an open position and a closed position, and the pawl biased by way of a spring to engage with teeth of the ratchet insert to prevent moving of the telescoping arm to the extended position without manipulating a release of a housing;

wherein the board rack is configured to secure the board between the claw, the first seat, and the second seat with the claw rotated to the closed position and the telescoping arm retracted.

12. The board rack of claim 11, wherein the telescoping arm is rotatably mounted to the base.

13. The board rack of claim 12, wherein the telescoping arm is configured to rotate with the first seat and the second seat.

14. The board rack of claim 11, wherein the telescoping arm is a first telescoping arm and further comprising a second telescoping arm.

15. The board rack of claim 11, wherein the telescoping arm further comprises a housing configured to be pulled toward the first seat and the second seat to retract the telescoping arm.

16. The board rack of claim 15, wherein the housing comprising a release and a lever, the release configured to be manipulated to rotate the claw open and permit extension of the telescoping arm, and the lever configured to be manipulated to rotate the claw closed.

17. The board rack of claim 11, wherein the housing is coupled to the pawl, the housing configured to be pushed and the release configured to be manipulated to rotate the pawl to disengage from the teeth of the ratchet insert.

18. The board rack of claim 11, wherein the telescoping arm further comprises a cable coupled to the claw and a lever, wherein the lever is configured to be manipulated to pull the cable to rotate the claw to the closed position.

19. A board rack configured to be incorporated onto a power boat, the board rack comprising:

a base;

a first seat and a second seat, the first seat and the second seat configured to receive a board; and a telescoping arm configured to move between an extended position and a retracted position, the telescoping arm comprising:

a claw configured to rotate between an open position and a closed position; and a housing comprising a trigger, the housing disposed between the claw and the base and configured to be pushed to rotate the claw open and move the telescoping arm to the extended position and pulled to move the telescoping arm to the retracted position, and the trigger configured to be squeezed to rotate the claw closed;

wherein the board rack is configured to secure the board between the claw, the first seat, and the second seat with the claw rotated to the closed position and the telescoping arm retracted.

20. A board rack configured to be incorporated onto a power boat, the board rack comprising:

a base;

a first pair of seats configured to receive a first board;

a second pair of seats configured to receive a second board;

a first telescoping arm configured to move between an extended position and a retracted position, the first telescoping arm comprising a first claw configured to cooperate with the first pair of seats to secure the first board between the first claw and the first pair of seats; and a second telescoping arm configured to move between an extended position and a retracted position, the second telescoping arm comprising a second claw configured to cooperate with the second pair of seats to secure the second board between the second claw and the second pair of seats;

wherein the first telescoping arm and the first pair of seats are configured to pivot together with respect to the base;

wherein the second telescoping arm and the second pair of seats are configured to pivot together with respect to the base; and wherein each of the first telescoping arm and the second telescoping arm comprises a pawl and a ratchet insert, the pawl biased by way of a spring to engage with teeth of the ratchet insert to prevent moving of the first telescoping arm and the second telescoping arm to the extended position without manipulating a release.

21. A board rack configured to be incorporated onto a power boat, the board rack comprising:

a base;

a first pair of seats configured to receive a first board;

a second pair of seats configured to receive a second board;

a first telescoping arm configured to move between an extended position and a retracted position, the first telescoping arm comprising a first claw configured to cooperate with the first pair of seats to secure the first board between the first claw and the first pair of seats;

a second telescoping arm configured to move between an extended position and a retracted position, the second telescoping arm comprising a second claw configured to cooperate with the second pair of seats to secure the second board between the second claw and the second pair of seats; and a first shaft and a second shaft, the first telescoping arm and the first pair of seats coupled to the first shaft, and the second telescoping arm and the second pair of seats coupled to the second shaft;

wherein the first telescoping arm and the first pair of seats are configured to pivot together with respect to the base;

wherein the second telescoping arm and the second pair of seats are configured to pivot together with respect to the base;

wherein longitudinal lengths of the first telescoping arm and the first shaft are perpendicularly orientated relative to each other; and wherein longitudinal lengths of the second telescoping arm and the second shaft are perpendicularly orientated relative to each other.

22. A board rack configured to be incorporated onto a power boat, the board rack comprising:

a base;

a first pair of seats configured to receive a first board;

a second pair of seats configured to receive a second board;

a first telescoping arm configured to move between an extended position and a retracted position, the first telescoping arm comprising a first claw configured to cooperate with the first pair of seats to secure the first board between the first claw and the first pair of seats;

a second telescoping arm configured to move between an extended position and a retracted position, the second telescoping arm comprising a second claw configured to cooperate with the second pair of seats to secure the second board between the second claw and the second pair of seats;

a first shaft and a second shaft, the first telescoping arm and the first pair of seats coupled to the first shaft, and the second telescoping arm and the second pair of seats coupled to the second shaft; and a first lever and a second lever;

wherein the first telescoping arm and the first pair of seats are configured to pivot together with respect to the base; and wherein the second telescoping arm and the second pair of seats are configured to pivot together with respect to the base; and wherein the first lever is configured to engage the first shaft to lock the first shaft in a position of rotation and the second lever is configured to engage the second shaft to lock the second shaft in a position of rotation.

23. A board rack configured to be incorporated onto a power boat, the board rack comprising:

a base configured to be incorporated with a tower of the power boat;

a first seat and a second seat, the first seat and the second seat configured to receive a board; and a telescoping arm configured to move between an extended position and a retracted position, the telescoping arm comprising a claw, a lever, and a cable coupled to the claw and the lever, the claw configured to rotate between an open position and a closed position, and the lever configured to be manipulated to pull the cable to rotate the claw to the closed position;

wherein the board rack is configured to secure the board between the claw, the first seat, and the second seat with the claw rotated to the closed position and the telescoping arm retracted.

* * * * *